US006374076B1

(12) United States Patent
Tanaka

(10) Patent No.: US 6,374,076 B1
(45) Date of Patent: Apr. 16, 2002

(54) IMAGE FORMING APPARATUS HAVING RELATIVE SHEET MATERIAL SPEED CONTROL

(75) Inventor: Toshiaki Tanaka, Fukaya (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/666,719

(22) Filed: Sep. 20, 2000

(30) Foreign Application Priority Data

Sep. 29, 1999 (JP) ..... 11-275537

(51) Int. Cl.[7] ..... G03G 15/14
(52) U.S. Cl. ..... 399/396; 399/45
(58) Field of Search ..... 399/45, 301, 303, 399/297, 298, 299, 381, 388, 389, 394, 396; 271/9, 110, 111, 258, 259, 266

(56) References Cited

U.S. PATENT DOCUMENTS

| | | | | |
|---|---|---|---|---|
| 4,916,547 A | | 4/1990 | Katsumata et al. | 358/300 |
| 5,652,943 A | * | 7/1997 | Matsuo | 399/45 X |
| 5,995,717 A | | 11/1999 | Tanaka | 395/109 |
| 6,112,037 A | * | 8/2000 | Nagata et al. | 399/45 |
| 6,118,463 A | * | 9/2000 | Houki et al. | 399/301 X |

FOREIGN PATENT DOCUMENTS

JP 10-161385 6/1998

OTHER PUBLICATIONS

U.S. application No. 09/667,098, Tanaka et al., filed Sep. 21, 2000.

* cited by examiner

*Primary Examiner*—Sophia S. Chen
*Assistant Examiner*—Hoan Tran
(74) *Attorney, Agent, or Firm*—Foley & Lardner

(57) ABSTRACT

An image forming apparatus according to the present invention is capable of making accurate adjustments so that a medium (for example, a sheet of paper) may fall in a proper relative speed range agreeing with the amount of allowable bend in the bending space of the medium, reliably preventing a color shift from occurring particularly in the color mode, which thereby improves the reliability. The image forming apparatus is characterized by including an OHP sheet identify sensor for recognizing or sensing the transport speed Va of a medium (a sheet of paper) fed from an aligning mechanism section to a transfer belt and a registration sensor for recognizing or sensing the transfer speed Vb of the medium on the transfer belt and by comparing the transport speed Va of the medium obtained from the OHP sheet identify sensor with the transport speed Vb of the medium obtained from the registration sensor and adjusting the transport speed Va and the transport speed Vb in such a manner that a state where the transport speed Va is faster than the transport speed Vb by a specific positive ratio of α % expressed by the following equation is satisfied:

$$Va=Vb\times(1+\alpha).$$

18 Claims, 12 Drawing Sheets

※ $T_{(a-e)}$--- PAPER SHEET TRANSPORT TIME FROM WHEN THE LEADING EDGE HAS PASSED THROUGH ALIGNING ROLLERS UNTIL THE TRAILING EDGE OF THE SHEET HAS BEEN DISCHARGED

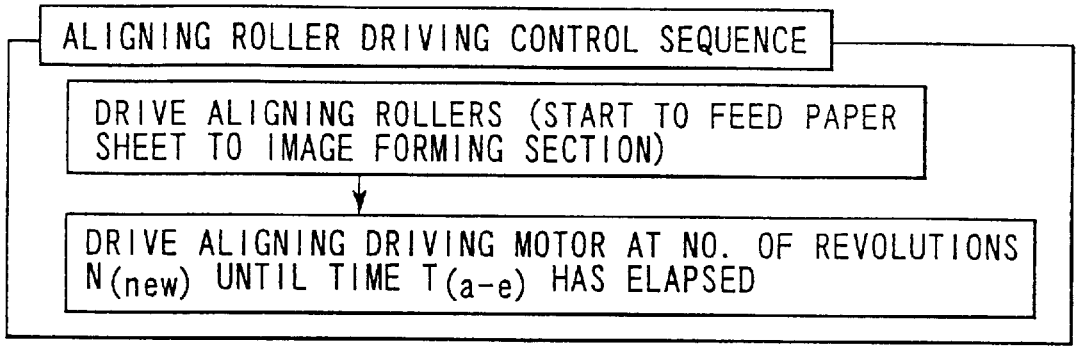

FIG. 13A

※ $T_{(a-y)}$--- PAPER SHEET TRANSPORT (THEORETICAL) TIME FROM WHEN THE LEADING EDGE OF PAPER SHEET HAS PASSED ALIGNING ROLLERS UNTIL THE LEADING EDGE HAS REACHED 1ST STATION

※ $T_{(y-e)}$--- PAPER SHEET TRANSPORT TIME FROM WHEN THE LEADING EDGE HAS REACHED 1ST STATION UNTIL THE TRAILING EDGE OF PAPER SHEET HAS BEEN DISCHARGED

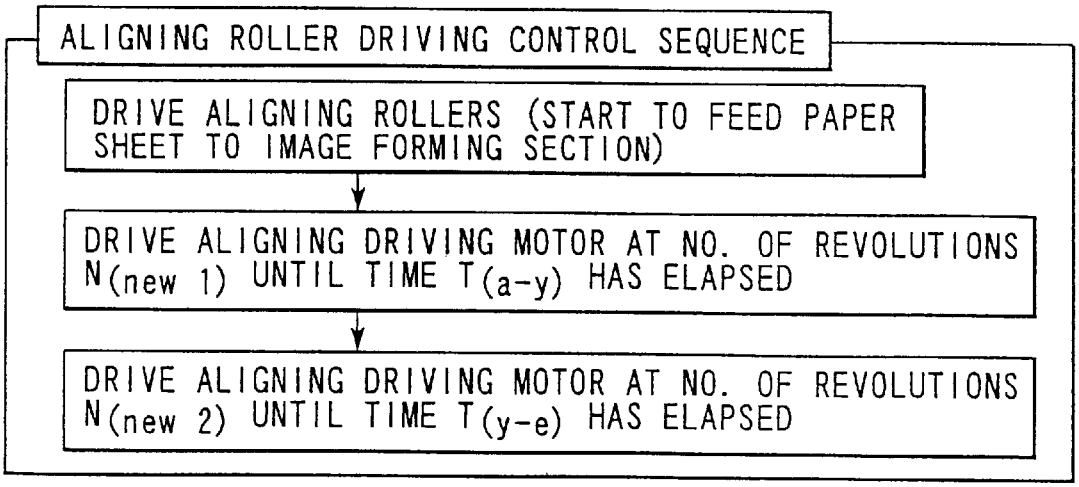

FIG. 13B

※ $T_{(a-y)}$--- PAPER SHEET TRANSPORT (THEORETICAL) TIME FROM WHEN THE LEADING EDGE OF PAPER SHEET HAS PASSED ALIGNING ROLLERS UNTIL THE LEADING EDGE HAS REACHED 1ST STATION

※ $T_{(y-m)}$--- PAPER SHEET TRANSPORT (THEORETICAL) TIME FROM WHEN THE LEADING EDGE HAS REACHED 1ST STATION UNTIL THE LEADING EDGE HAS REACHED 2ND STATION

※ $T_{(m-e)}$--- PAPER SHEET TRANSPORT TIME FROM WHEN THE LEADING EDGE HAS REACHED 2ND STATION UNTIL THE TRAILING EDGE OF PAPER SHEET HAS BEEN DISCHARGED

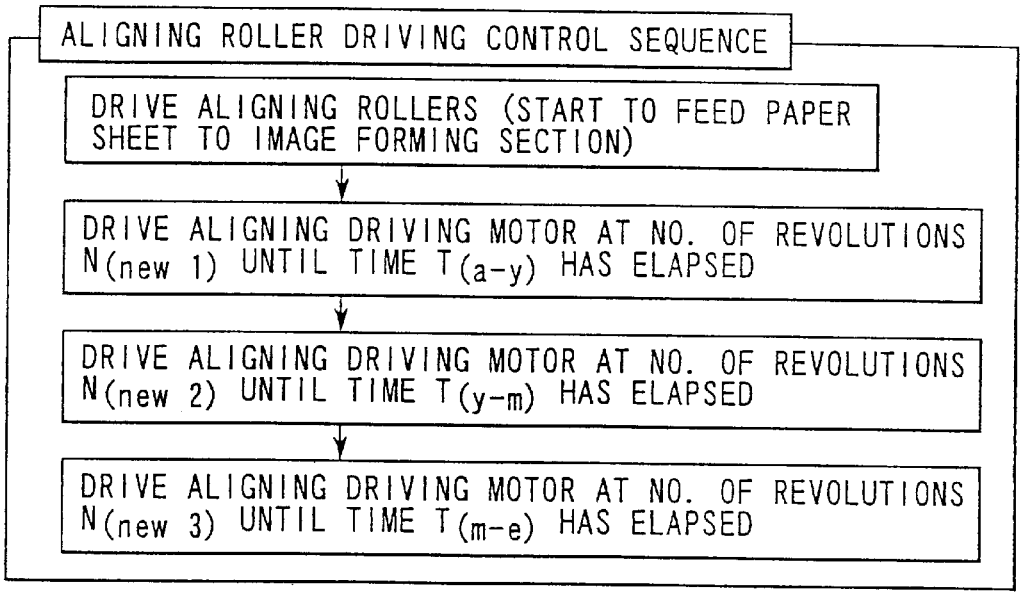

FIG. 13C

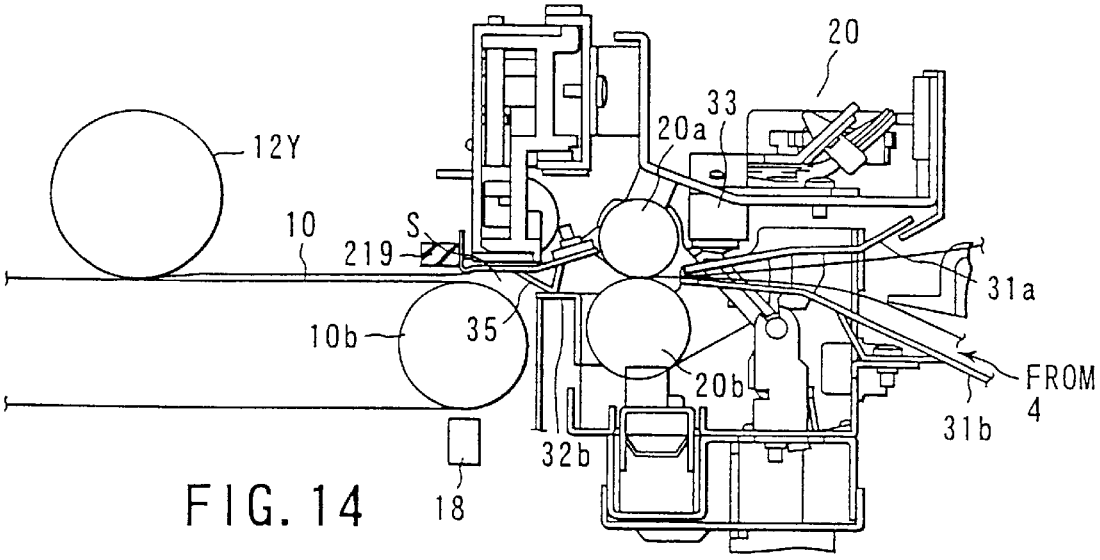

FIG. 14

IMAGE FORMING APPARATUS HAVING RELATIVE SHEET MATERIAL SPEED CONTROL

CROSS-REFERENCE TO RELATED APPLICATIONS

This application is based upon and claims the benefit of priority from the prior Japanese Patent Application No. 11-275537, filed Sep. 29, 1999, the entire contents of which are incorporated herein by reference.

BACKGROUND OF THE INVENTION

This invention relates to a color image forming apparatus which forms color images by superimposing single-color images, such as an electrophotographic color electronic copying machine or a color printer.

In many color image forming apparatuses, the following method has been widely used, a specific number of single-color image forming units (normally, four units), defined by subtractive primaries, each unit being composed of a photosensitive member and a developing unit, are arranged in series and a yellow (Y) image, a magenta (M) image, a cyan (C) image, and a black (B) image for reinforcing the contrast between light and shade. Each formed by the corresponding image forming unit are stacked one on top of another in sequence on a paper sheet or a transparent resinous sheet for overhead projectors transported by a transfer belt provided along each image forming unit. Another known method of stacking four images is to transfer four images to an intermediate transfer member and then transfer the stacked images on the intermediate transfer member to a sheet material at one time.

Since such a color image forming apparatus requires four color (four) images to be stacked on top of another accurately, it is often provided with various controls for obtaining exactly aligned images.

For example, in the photosensitive member (drum like) peripheral speed control, the rotation of the drum (photosensitive member) driving motor is controlled to a constant value so that the photosensitive member peripheral speed at which a given point on the outer surface of the photosensitive member provided on each of the four image forming units is moved may become equal to the belt speed at which a given point on the transfer belt rotated by a belt motor is moved. Moreover, in belt peripheral speed control, the rotational speed of the transfer belt motor driving the transfer belt is sensed and the rotation of the belt driving motor is controlled to a constant value so that the photosensitive member peripheral speed may become equal to the belt speed.

Because the contact part where the photosensitive member of each of the four image forming units comes into contact with the transfer belt is separated, such a correction is made as shifts the image forming timing at the stacked part according to the separation.

Actually, however, it is difficult to obtain a stacked image without any shift because of various factors, including a shift in the position when exposure light is projected on each photosensitive member, a shift in the pitch of the photosensitive member (the image forming unit) each other, the slip between the driving roller for driving the transfer belt and the transfer belt, and changes in the peripheral speed of the transfer belt due to fluctuations in the diameter of the driving rollers that drive the transfer belt caused by thermal expansion.

To overcome the disadvantages, there is also provided a control sequence that causes the degree of the color shift in superimposing the images during the power turn-on time or the warm-up time after the cover or the like is opened and closed to restore the operation from the state where a sheet material, i.e., the paper sheet or the resinous sheet got jammed inside the apparatus. There is further provided an image density control sequence for maintaining the image density, the amount of toner adhered, suitably even when the characteristic varies with temperature or time.

Even if various corrections or controls are have been performed as described above, the difference between the sheet material transport speed at which the aligning roller feeding the sheet material to the transfer belt transports the sheet material and the peripheral speed of transfer belt would cause a color shift (a shift in the position of the stacked images).

For example, when the transport speed of the aligning roller is slower than the peripheral speed of the transfer belt, the aligning roller applies a load to the sheet material on the transfer belt in the opposite direction to the direction in which the sheet material is moved (the aligning roller pulls the sheet material), with the result that a color shift occurs throughout the whole surface of the sheet material. Moreover, the effect of vibrations or the like of the paper feed driving system transmitted from the aligning roller causes jitters.

Conversely, when the transport speed of the aligning roller is faster than the peripheral speed of the transfer belt, a large bend occurs in the sheet material in the space defined by an upper guide and a lower guide provided in such a manner that they sandwich the sheet material between them from above and below, in the direction in which the aligning roller transports the sheet material between an electrification roller for causing the sheet material to adhere to the transfer belt by an electrostatic force and the aligning roller. After the bend in the sheet material has grown to the extent that the space cannot absorbs the bend, when the bend stretches, pitching (or waving) takes place in the sheet material in the direction in which the sheet material on the transfer belt is pushed out, shifting the position of the sheet material on the transfer belt, which results in a color shift.

As described above, the sheet transport speed that the aligning roller is required to have has a narrow suitable speed range. It is unfavorable that the sheet transport speed should be too fast or too slow. A single-color-only (black-only) image forming apparatus has no color superimposition. In an image forming apparatus involving digital processing, the density gradation is binarized and expressed by the density of pixels, which makes jitters less liable to take place.

In contrast, a color image forming apparatus requires color superimposition and subjects the density gradation to multivalued processing, forming pixels of different sizes with an equal pitch, which makes jitters conspicuous.

Furthermore, in a small color printer or color copying machine, the size of the apparatus is limited and the distance between the aligning roller and the image forming section cannot be made long. Since the electrification roller for causing paper to adhere to the transfer roller by electrostatic force in the monochrome mode is located in the same position even in the color mode, this reduces the bending space.

As described above, the following problem exists: in the paper sheet bending space defined by sheet guides provided between the aligning roller and transfer belt, an enough space to allow the sheet of paper to bend sufficiently cannot be secured. A known apparatus of this type has the following problem: the length of a sheet of paper that is allowed to bend is 2 mm or less and the proper speed range for the A3 longitudinal size 420 mm is limited to 0.48% or less.

BRIEF SUMMARY OF THE INVENTION

The object of the present invention is to provide a color image forming apparatus which causes the relative difference between the sheet material transport speed at a sheet material feeding unit and that of an image forming unit to fall in a proper speed range, thereby preventing a color shift particularly in a color mode.

The foregoing object is accomplished by providing an image forming apparatus comprising: an image forming section for forming images using developer; a feeding mechanism for feeding an image forming medium to the image forming section; a transport mechanism for transporting the image forming medium fed by the feeding mechanism; a transfer unit for transferring the developer image formed by the image forming section onto the image forming medium; a fixing unit for fixing the transferred developer image; a first sensing unit for recognizing or sensing the transport speed Va of the image forming medium fed from the feeding mechanism to the image forming section; a second sensing unit for recognizing or sensing the transport speed Vb of the image forming medium at the image forming section; and a control unit for comparing the transport speed Va of the image forming medium obtained from the first sensing unit and the transport speed Vb obtained from the second sensing unit and for controlling a proper relative speed with respect to the transport speed Va and the transport speed Vb.

The foregoing object is further accomplished by providing an image forming method in an image forming apparatus including an OHP sheet identify sensor for recognizing or sensing the transport speed Va of a medium fed from an aligning mechanism section to a transfer belt and a registration sensor for recognizing or sensing the transfer speed Vb of the medium on the transfer belt, the image forming method comprising the steps of: comparing the transport speed Va of the medium obtained from the OHP sheet identify sensor with the transport speed Vb of the medium obtained from the registration sensor and adjusting the transport speed Va and the transport speed Vb in such a manner that a state where the transport speed Va is faster than the transport speed Vb by a specific positive ratio of $\alpha$ % expressed by the following equation is satisfied:

$$Va=Vb\times(1+\alpha)$$

The foregoing object is still further accomplished by providing an image forming apparatus comprising: an image forming section for forming images using developer; a feeding mechanism for feeding an image forming medium to the image forming section; a transport mechanism for transporting the image forming medium fed by the feeding mechanism; a transfer unit for transferring the developer image formed by the image forming apparatus onto the image forming medium; a fixing unit for fixing the transferred developer image; a first sensing unit which is a reflection-type or a transmission-type optical sensor for determining whether the medium is paper or OHP or verifying the passage of the medium and recognizes or senses the transport speed Va of the medium fed from the feeding mechanism to the image forming section; a second sensing unit which is a registration sensor for sensing a shift in the position of an image that is an optical sensor for sensing and measuring various adjustment marks formed on the transfer means and recognizes or senses the transport speed Vb of the medium at the image forming section; and a control unit for comparing the transport speed Va of the medium obtained from the first sensing unit with the transport speed Vb of the medium obtained from the second sensing unit and controlling the transport speed Va of the medium at the feeding mechanism and the transport speed Vb of the medium at the image forming section to specific speeds in such a manner that the following equation is satisfied:

$$Va=Vb\times(1+\alpha)$$

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 13A to 13C are flowcharts to explain the aligning roller driving control sequence in the image forming apparatus of FIG. 1; and FIG. 14 is a schematic diagram to explain another example of the aligning section explained in FIG. 5.

DETAILED DESCRIPTION OF THE INVENTION

Hereinafter, referring to the accompanying drawings, a color image forming apparatus according to an embodiment of the present invention will be explained in detail.

Figure 1:
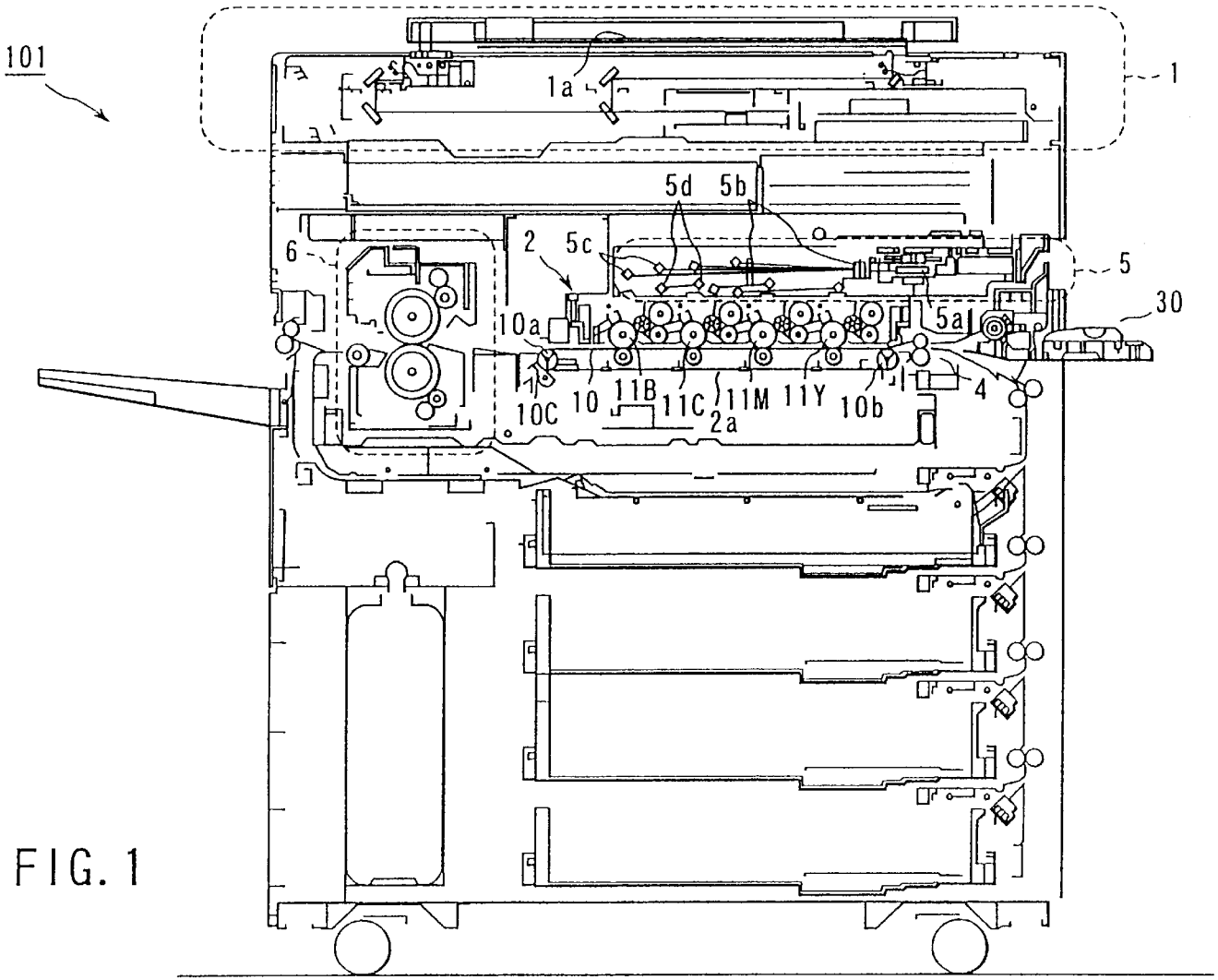
FIG. 1 is a schematic diagram showing the configuration of a four-drum color image forming apparatus to which an embodiment of the present invention is applied.

FIG. 1 is a schematic diagram to explain a four-drum color copying machine which is a full-color electrophotographic color image forming apparatus, a type of multicolor-superimposing image forming apparatus, and which has electrophotographic process units provided on the same transfer belt.

As shown in FIG. 1, a color copying machine 101 has an original table 1*a* on which an object to be copied, such as an original or a book, is placed. In the color copying machine 101, the image data read by a scanner 1 from an original (not shown) put on the original table 1*a* or the image data from an external apparatus (not shown), such as a computer, is stored in an image memory explained later. Then, an image data processing circuit, explained later using FIGS. 3A and 3B, processes the image data. Thereafter, an image forming unit 2, explained below, forms a color image. The image data may take any data form that can be applied to the additive primaries R, G and B or to the subtractive primaries C, M and Y.

Figure 2:
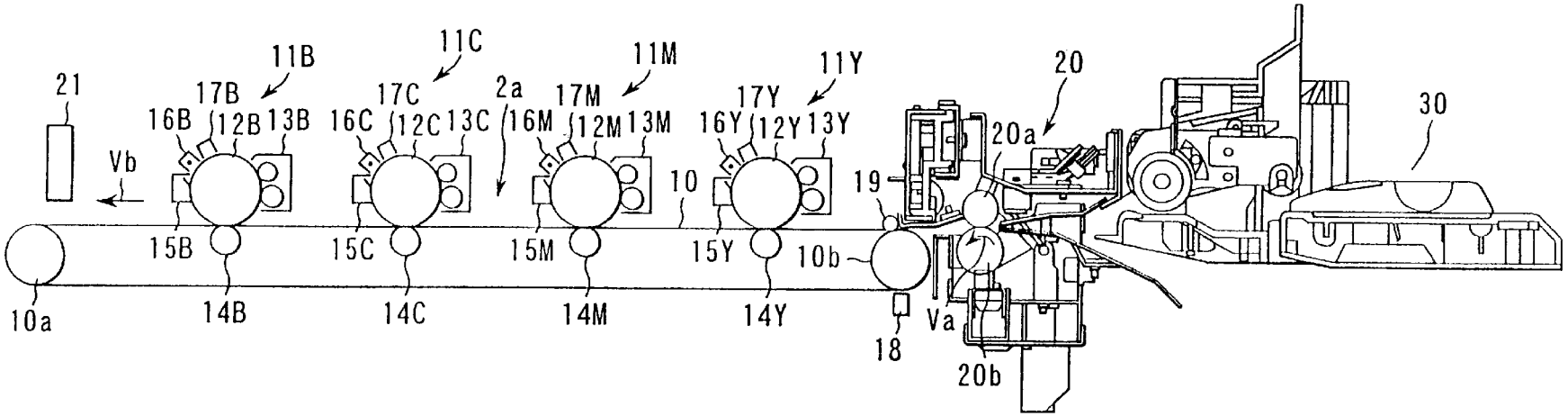
FIG. 2 is a schematic diagram to explain the image forming unit in the image forming apparatus of FIG. 1.

As shown in an enlarged view of FIG. 2, the image forming unit 2 has a first, a second, a third, and a fourth image forming section 11 that form four (four color) images on the basis of four image forming signals of Y (Yellow), M (Magenta), C (Cyan), and B (sumi-Black) color-separated according to the subtractive primaries. Because a total of four sets of the image forming sections 11 and many elements constituting the image forming sections 11 are provided to deal with Y, M, C and B, they are identified by adding the subscripts Y, M, C and B, as the need arises.

The image forming sections 11Y, 11M, 11C and 11B are caused to face an endless belt (transfer belt) 10 in such a manner that the distance between the units 11 (Y, M, C and B) and the transfer belt 10 that transports a sheet material O, e.g., transparent resinous sheet for overhead projectors or sheet papers (each are named image output medium), is kept constant. The image forming sections 11 (Y, M, C and B) are arranged at specific intervals along the surface of the transfer belt 10.

Each of the image forming sections 11 (Y, M, C and B) includes a photosensitive drum 12 on which a latent image corresponding to the Y, M, C or B image forming signal is formed and a developing unit 13 that holds a corresponded-color toner of the latent image to visualize the latent image formed on the photosensitive drum 12. The order in which the image forming sections 11 (Y, M, C and B) are arranged can be defined arbitrarily. In the embodiment of the present invention, because a Y image, an M image, a C image, and a B image, four color images, are superimposed from the upstream side in the direction in which a given point on the transfer belt 10 is moved, or the direction in which the sheet material O is transported, the image forming sections 11 (Y, M, C and B) are arranged in that order.

Around the photosensitive drum 12 of each image forming section 11 (Y, M, C and B) and at a position that faces each photosensitive drum 12, with the transfer belt 10 being pressed against the drum, there is provided a transfer unit 14 that electrostatically transfers the toner image (Y, M, C and B) formed on each photosensitive drum 12 onto the sheet material O electrostatically adhering to the transfer belt 10 by electrostatic force.

Further provided around the photosensitive drum 12 are a cleaner unit 15 for removing the toner left on the surface of each photosensitive drum after the transfer unit 14 has transferred each toner image onto the sheet material O, a discharging unit 16 for removing the charges remaining on each photosensitive drum from which each cleaner 15 has removed the toner, and a charging unit 17 for applying a specific potential to each photosensitive drum 12.

The transfer belt 10, which is made of about 0.5-mm-thick conductive polyurethane rubber, is stretched over a first roller (driving roller) 10*a* and a second roller (driven roller) 10*b*. As the driving roller 10*a* is rotated, a given point on the transfer belt 10 is moved in a specific direction. (It goes without saying that) The direction in which a given point on the transfer belt 10 is moved is the direction in which the sheet material O is conveyed. In the embodiment, the direction in which the sheet material O is transported is from the first image forming section 11Y toward the fourth image forming section 11B in making an observation on one of the two surface sides of the transfer belt 10 that is closer to the four image forming sections 11. The transfer belt 10, driving roller 10*a*, driven roller 10*b*, a belt motor, explained later in FIGS. 3A and 3B, for driving the driving roller 10*a*, and others constitute the peripheral section of the transfer section. The peripheral section serving as a transfer unit 2*a* can be installed or removed on or from the photosensitive drum 12 of each image forming section 11 in forming a single color (B image) explained below.

An electrification unit 18 for charging static electricity on the transfer belt 10 to cause the sheet material O to adhere to the belt by the electrostatic force in advance is provided on the inner side of the transfer belt 10 on the first image forming section 11Y side in the direction in which the sheet material O is transported, and at a specific position close to a transfer medium feeding section 4 for feeding the sheet material O to the transfer belt 10. In addition, an electrification roller 19 for causing the sheet material O to make close contact with the transfer belt 10 previously charged by the electrification unit 18 is provided on the outer side of the transfer belt 10 and at the position where the transfer medium feeding section 4 presses the sheet material O against the transfer belt 10 on the slightly downstream side in the direction in which the sheet material O is transported.

Between the transfer belt 10 and the transfer medium feeding section 4 and at the position of the transfer medium feeding section 4 a little away from the transfer belt 10 as compared with the position where the sheet material O is fed onto the outer side of the transfer belt 10, an aligning unit 20 is provided which aligns the sheet material O in such a manner that the leading edge of the sheet material O fed toward the outer side of the transfer belt 10 is positioned perpendicular to the direction of transportation of the sheet material O and the sheet material O is transported while keeping right angles with the direction of transportation of the sheet material O. The aligning unit 20 is composed of a first and a second aligning roller 20*a* and 20*b* that sandwich the sheet material O between them from above and below and an aligning motor 20*m* (see FIGS. 3A and 3B) for driving one roller. With the rollers being stopped, they take in the leading edge of the sheet material O transported from the transfer medium feeding section 4 and stop the sheet material O temporarily, thereby bending the leading edge of the sheet material O. When the rotation of both of the rollers 20*a* and 20*b* with a specific timing allows the leading edge of the sheet material O to return to the original state, the aligning rollers 20*a*, 20*b* align the leading edge of the sheet material O in such a manner that the leading edge is perpendicular to the direction of transportation of the sheet material O and the sheet material O is transported, while keeping right angles with the direction of transportation of the sheet material O.

In a specific position above each image forming section 11 (Y, M, C and B) in the image forming unit 2, there is provided an exposure unit 5 including a laser diode (not shown) that emits each color exposure light (laser beam) with the timing set at an image forming timing control circuit 113, on the basis of the image forming signal obtained by processing images for each color image data at an image data control section 115 explained later using FIGS. 3A and 3B.

In the exposure unit 5, while, for example, a polygonal mirror 5*a* is deflecting the laser beam from the laser diode whose intensity of laser beam is varied according to the image forming signal corresponding to each color, in the direction of the axis of each photosensitive drum 12 (in the direction perpendicular to the direction in which the sheet material is transported), cylinder lenses 5*b* and plane mirrors 5*c*, 5*d* project the laser beam onto each photosensitive drum 12 in sequence. This forms an electrostatic latent image corresponding to each color on each photosensitive drum 12 in each image forming section 11.

A fixing unit 6 for fixing a four-color toner image retained on the sheet material to the sheet material O is located in a position more separate from the first roller 10*a*. The fixing unit 6 is composed of a first roller (heating roller) which is a circular cylinder formed to a specific thickness, a second roller (pressurizing roller) provided in parallel with the axis of the first roller and in the longitudinal direction of the first roller in such a manner that it is brought into contact with the periphery of the first roller at one point, and a heater (not shown) for heating at least one of the rollers. With pressure being applied between the two rollers, the sheet material O is passed through between the two rollers, thereby heating and pressurizing the sheet material O and the toner electrostatically adhering to the sheet material O, which fixes the toner to the sheet material O.

Figure 3A:
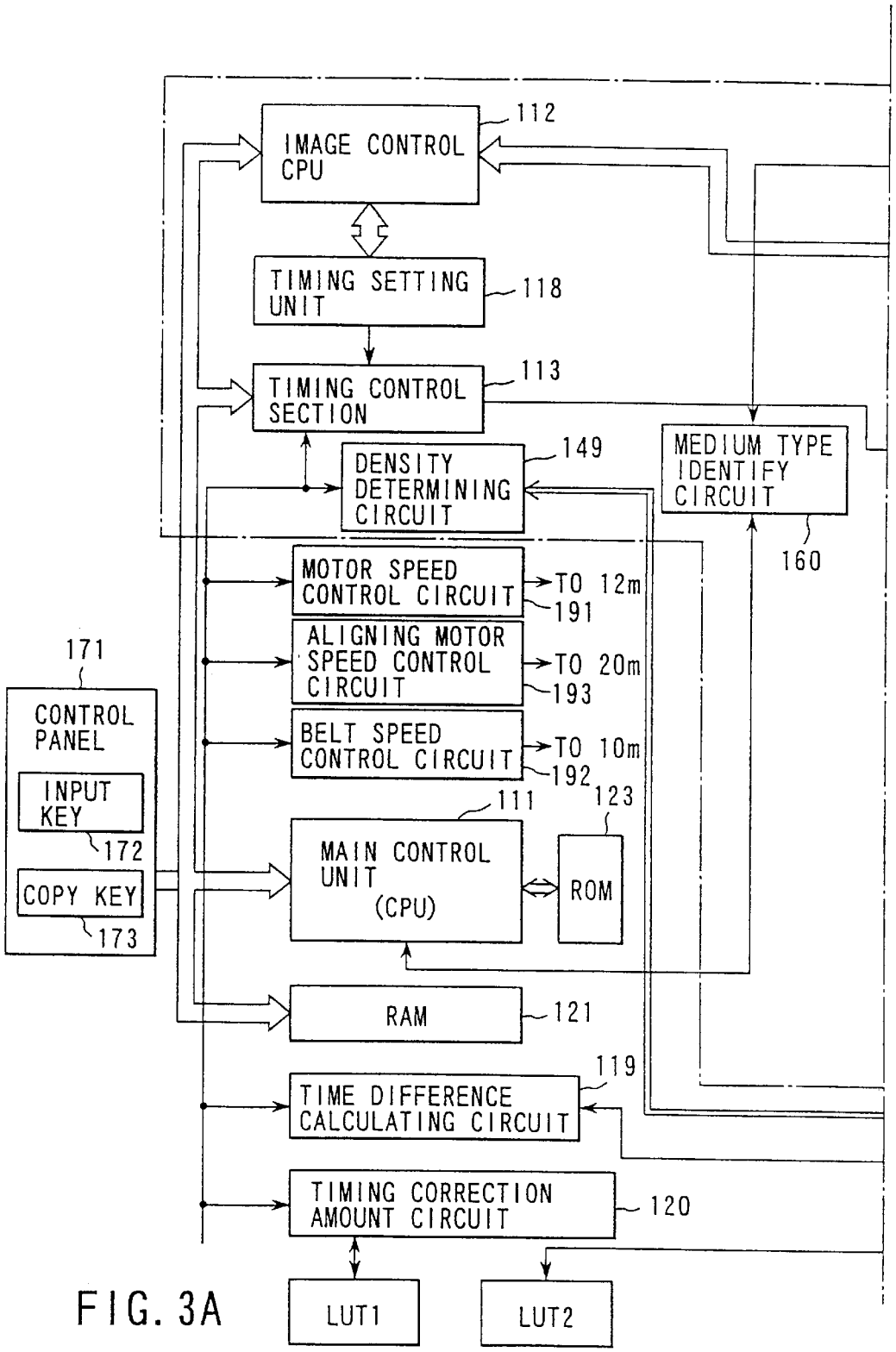
FIGS. 3A and 3B are a control block diagram of the image forming apparatus of FIG. 1.
Figure 3B:
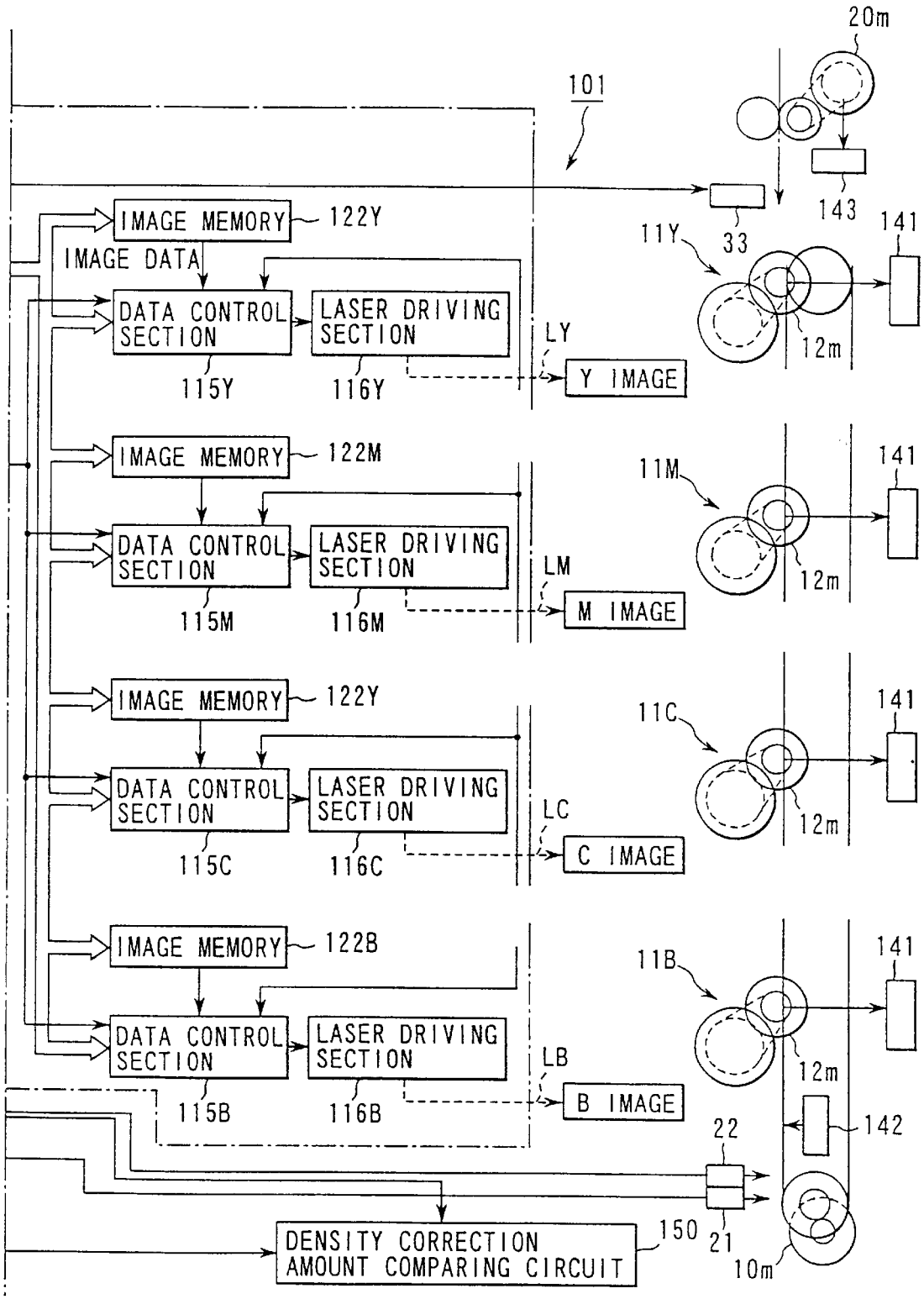

FIGS. 3A and 3B are a schematic block diagram to explain an example of the control circuit for controlling each of the four image forming sections 11 (Y, M, C and B) in the color copying machine 101 of FIG. 1.

After an image formation start signal has been supplied from an operator panel or a host computer, each of the image forming sections 11 (Y, M, C and B) is warmed up under the control of a main control unit 111 and the polygonal mirror 5*a* of the exposure unit 5 is rotated at a specific rotational speed under the control of an image control CPU 112.

Then, under the control of the main control unit 111, the image data to be printed is loaded from an external unit, such as a scanner 1 or a computer, into a RAM 121 serving as a work memory. Part (or all) of the image data loaded into the RAM 121 is stored in the four image memories 122 (Y, M, C and B) under the control of the image control CPU 112.

Under the control of the main control unit 111, a cassette or a bypass feeding section 30 feeds the sheet material O toward the transfer medium feeding section 4 with specific timing, for example, on the basis of the vertical synchronizing signal from the timing control section 113. The aligning section 20 where the first and second aligning rollers 20*a*, 20*b* are in contact with each other matches the timing for the sheet material O transported to the transfer medium feeding unit 4 with the timing for each of the Y, M, C and B toner images produced by the image forming operation. Then, the electrification roller 19 causes the sheet material O to come in close contact with the transfer belt 10. As the transfer belt 10 rotates, the sheet material O is guided toward each image forming section 11 (Y, M, C and B).

On the other hand, in parallel with or simultaneously with the feeding and transporting operation of the sheet material O, each color laser in the exposure unit 5 is energized by the corresponding one of the laser driving sections 116 (Y, M, C and B) on the basis of the clock signal CLK outputted from a timing setting unit (clock circuit) 118. At the same time, under the control of the corresponding one of the data control sections 115 (Y, M, C and B), the laser diode is intensity-modulated according to the image data DAT held in the RAM 121 and then emits light. As a result, one line of laser beam is projected on the photosensitive drum 12 of each image forming section 111 from a specific position of the effective printing width in the main scanning direction in parallel with the axis of the drum 12.

In this way, under the control of each of the data control sections 115 (Y, M, C and B), the image data is transferred to each of the laser driving sections 116 (Y, M, C and B) to vary the intensity of each of the laser beams L (Y, M, C and B) emitted from the respective light sources in the exposure unit 5 (not shown). As a result, one scan of the laser beam forms an image without a shift on the photosensitive drum 12 (Y, M, C or B) of each of the image forming sections 11 (Y, M, C and B) using an image clock of a constant clock length.

The first to fourth laser beams L (Y, M, C and B) converging on the respective photosensitive drums 12 (Y, M, C and B) of the first to fourth image forming sections 11 (Y, M, C and B) form an electrostatic latent image corresponding to the image data on the respective photosensitive drums 12 (Y, M, C and B) by varying the potential, according to the image data, of the respective photosensitive drums 12 (Y, M, C and B) charged previously to a specific potential.

The electrostatic latent image is converted by each of the developing units 13 (Y, M, C and B) into a toner image of the corresponding color.

Each toner image is moved to a sheet material O transported by the transport belt 10, as each of the photosensitive drums 12 (Y, M, C and B) rotates. With predetermined timing, a transfer unit 14 transfers the toner image to the sheet material O on the transport belt 10.

This forms a precisely superimposed four-color toner image on the sheet material O. After the toner image has been transferred to the sheet material O, the remaining toner on each of the photosensitive drums 12 (Y, M, C and B) is removed by the corresponding one of the cleaners 15 (Y, M, C and B). In addition, the remaining potential at each of the photosensitive drums 12 (Y, M, C and B) is discharged by the corresponding one of the discharging lamps 16 (Y, M, C and B) and used for subsequent image formation.

The sheet material O electrostatically retaining the four-color toner image is further conveyed as the transport belt 10 rotates. The difference between the curvature of the belt driving roller 10*a* and the straight advance of the sheet material O separates the sheet from the transport belt 10. The sheet is then guided to the fixing unit 6. The fixing unit 6 fuses the toner on the sheet material O guided therein, thereby fixing the toner image as a color image on the sheet. Thereafter, the sheet is discharged to an outlet tray (not shown).

On the other hand, after the transport belt 10 has delivered the sheet material O to the fixing unit 6, the belt cleaner 10*c* removes the unwanted toner remaining on the surface, while the belt 10 is being further rotated. Then, the belt 10 is used again to transport the sheet material O fed from the transfer medium feeding section 4.

In such a color copying machine 101, the four photosensitive drums 12 (Y, M, C and B) of the image forming sections 11 (Y, M, C and B) are rotated at a given number of revolutions by drum motors 12*m* (Y, M, C and B). Thus, the speed at which a given point on the outer surface of each drum motor is moved, or the drum peripheral speed is not necessarily equal to the speed at which the sheet material O is transported. Therefore, the number of revolutions of each drum motor 12*m* is controlled to a constant value as follows: the difference Vmerr between a reference value Vmref of a speed signal set so that the moving speed of the outer surface of each photosensitive drum 12 may be equal to the speed at which a given point on the transfer belt 10 is moved and the speed signal Vmdet sensed by a motor rotation sensor 141 is amplified and the resulting value is fed back to the number of revolutions of each photosensitive drum 12*m* through feedback control by a control circuit 191. The speed at which the sheet material O is transported, the drum peripheral speed of each photosensitive drum 12, and the speed at which a given point on the transfer belt 10 is moved, or the belt speed, are the same, and called, for example, the process speed.

Similarly, the number of revolutions of the belt motor 10*m* that rotates the driving roller 10*a* to move the transfer belt 10 at a specific speed in the direction in which the sheet material O is transported is sent as a speed signal Vbdet generated by a belt speed sensor 142 to a belt speed control circuit 192. The number of revolutions of the belt motor 10*m* is controlled to a constant value as follows: the difference Vberr between a reference value Vbref of a speed sense signal set so that the outer surface speed of the photosensitive drum 12 may be equal to the speed of the transfer belt 10 and the speed signal Vbdet sensed by the belt speed sensor 142 is amplified and the resulting value is fed back to the number of revolutions of the belt motor 10*m* through feedback control by a control circuit 192.

The number of revolutions of the aligning motor 20*m* that rotates one of the aligning rollers 20*a*, 20*b* is sent as a speed signal Vadet generated by an aligning motor speed sensor 143 to an aligning motor speed control circuit 193, which compares the signal Vadet with an reference value Varef and controls the rotational speed to a constant value (only while the motor is rotating).

In such a color copying machine 101, the toner images (Y, M, C and B) are formed by the photosensitive drums 12 (Y, M, C and B) of the four image forming sections (Y, M, C and B) and developed by the developing units 13 (Y, M, C and B) that have toners of the corresponding colors and selectively supply the toners to the electrostatic latent images. The toner images are caused to adhere electrostatically to the transfer belt 10 by suction and then are transferred by the transfer unit 14 to the sheet material O transported as the transfer belt 10 moves. At this time, the moving speed Vm of the outer surface of the photosensitive drum 12 and the speed vb of the transfer belt 10 are controlled to the same value, theoretically preventing the toner images from being shifted or blurred.

Since the parts where the four photosensitive drums 12 and the transfer belt 10 are in contact with each other are separated in the direction in which the transfer belt 10 moves, the timing with which each of the image forming sections 11 (Y, M, C and B) forms an image of the corresponding color is shifted in time by the value expressed as:

the distance between the photosensitive drums for the respective colors/the speed of the transfer belt 10 (process speed)

In this way, the color toner image obtained by superimposing the respective toner images on the sheet material O is fixed on the sheet material O by the fixing unit 6.

Figure 4:
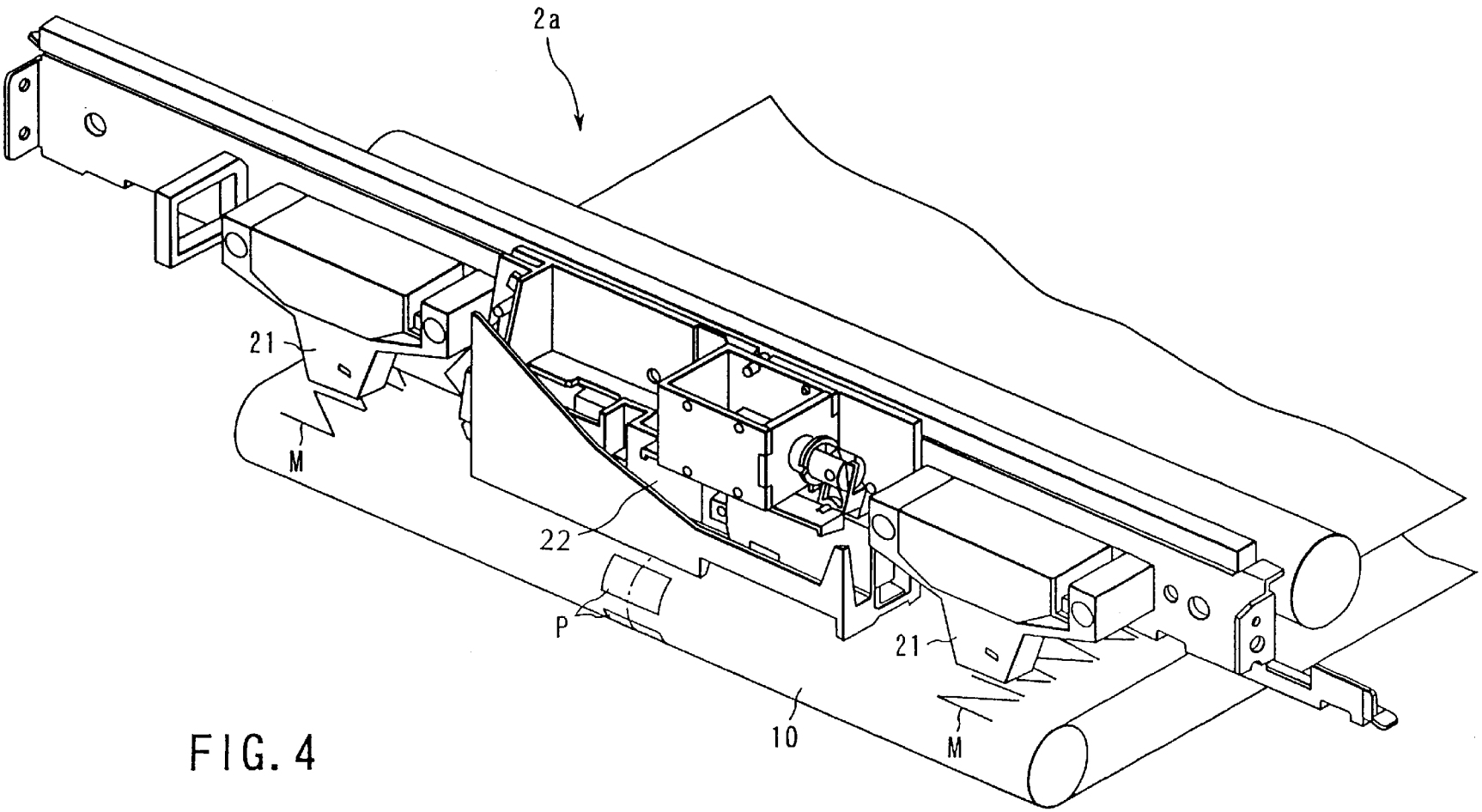
FIG. 4 is a schematic diagram to explain a mechanism for correcting a relative shift in the position of the image formed by each image forming unit in the image forming apparatus of FIG. 1.

FIG. 4 is a schematic diagram to explain a mechanism for correcting shifts in the positions of the images actually formed by the image forming sections 11 (Y, M, C and B) in the color copying machine 101 of FIG. 1. The properties of the toner vary with temperature or time and the amount of toner adhering to the photosensitive drums or the sheet material O, or the image density, often varies. A sequence for correcting the image density will also be explained later.

First, correction of a shift in the position of an image will be explained.

As shown in FIG. 4, a registration sensor 21 for sensing the passage of a registration mark M for finding a shift in the position of each toner image in the direction perpendicular to the direction in which a given point on the transfer belt is moved is provided in a position along the surface of the transfer belt 10 further down where each of the image forming sections 11 (Y, M, C and B) faces the transfer belt 10 on the downstream side in the direction in which a given point on the transfer belt is moved. The registration sensor 21 is provided in two places spaced a specific distance apart in the direction of width of the transfer belt 10 (in the direction perpendicular to the direction in which the sheet material O is transported).

Each sensor 21 senses in sequence the fact that the registration marks M formed by each of the image forming sections 11 (Y, M, C and B) in specific areas on the transfer belt 10 have passed the sensing area of each sensor and outputs mark sense signals. The mark sense signals are inputted sequentially to a time difference computing circuit 119. The time difference computing section 119 calculates the time difference between the mark sense signals, or the individual registration marks M. Thus, the time difference computing section 119 outputs the time difference between the individual marks M.

Next, a timing correction comparing circuit 120 refers to a lookup table LUT1 and, according to the time difference calculated by the time difference computing circuit 119, determines the amount of correction Z by which the timing that each of the image forming sections (Y, M, C and B) forms an image is corrected.

Thereafter, feedback is applied to the timing control circuit 113 according to the determined amount of correction Z. This corrects the timing with which each of the image forming sections 11 (Y, M, C and B) should form an image, that is, the image exposure timing with which the exposure unit 5 projects a laser beam corresponding to the image forming signal onto the photosensitive drum 12 of the image forming section 11 of each color, which corrects the level of a shift in the position of the image. The formation of the registration mark M, the computation of the time difference between the individual marks M, the computation of the amount of correction Z, and the correction of the exposure timing are repeated as many times as needed until the level of a shift in the position of an image falls in an allowed level.

Next, an image density correction sequence for optimizing the image density (output image density) will be explained.

A toner density sensor 22 for sensing the amount of toner adhering to the photosensitive drum 12 or transfer belt 10, or the amount of adhering toner, is provided in the vicinity of and in the same phase in the direction of transportation of the sheet material with the registration sensor 21 explained above and almost in the middle in the direction perpendicular to the direction of transportation of the sheet material O.

The sensor 22 senses that the density patch P for controlling each color density formed with specific timing has passed the sensing area of the sensor 22 and outputs patch sense signals. The patch sense signals are inputted sequentially to a density judging circuit 149. The density judging circuit 149 outputs the density difference between the individual patch sense signals or the individual density patches P.

Thereafter, a density correction comparing circuit 150 refers to a lookup table LUT2 and, on the basis of the density determined by the density judging circuit 149, determines the amount of correction X by which the density of the image formed by each of the image forming sections 11 (Y, M, C and B) should be corrected.

Next, feedback is applied to the density judging circuit 149 according to the amount of correction X determined. This varies, according a specific routine, the factors controlling the image density when each of the image forming sections 11 (Y, M, C and B) forms an image, such as the exposure (the intensity of laser beam) from the exposure unit 5, the developing bias voltage of the developing unit 13, the transfer voltage by the transfer unit 14, or the amount of charges on the photosensitive drum 12 applied by the charging unit 17, which forms a new density patch P. The formation of the density patch P, the calculation of the density of each patch P, the calculation of the amount of correction X, and the correction of exposure timing are repeated as many times as needed until the image density D has reached an allowed level.

Figure 5:
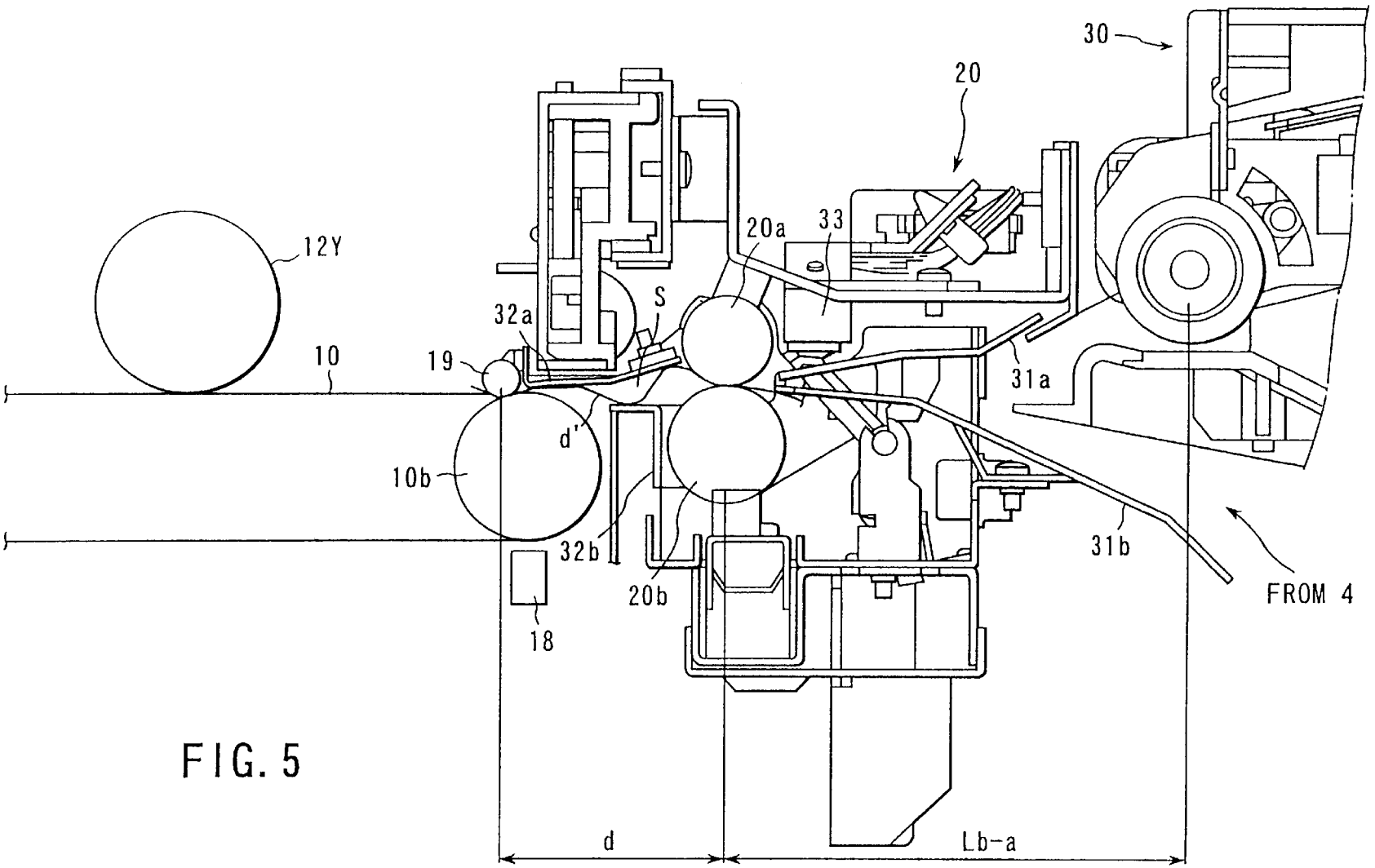
FIG. 5 is a schematic diagram to explain the aligning section and its vicinity in the image forming apparatus of FIG. 1.

FIG. 5 is a schematic diagram to explain the aligning section 20 and its vicinity. As shown in FIG. 5, the bypass feeding section 30 capable of feeding the sheet material O is provided independently of the transfer medium feeding section 4 in the vicinity of the aligning rollers 20*a*, 20*b* of the aligning section 20 on the upstream side in the direction in which the sheet material O is transported to the transfer unit 2*a*. A first upper guide plate 31*a* and a first lower guide plate 31*b* are provided between the bypass feeding section 30 and the aligning rollers 20*a*, 20*b*. A second upper guide plate 32*a* and a second lower guide plate 32*b* are provided between the aligning rollers 20*a*, 20*b* and the transfer belt 10.

An OHP sheet identify sensor (hereinafter, abbreviated as an OHP identify sensor) 33 for determining whether the sheet material O is a transparent OHP sheet for overhead projectors is provided in a specific position between the aligning rollers 20*a*, 20*b* and the first upper guide plate 31*a*. When the sheet material O passing through the aligning section 20 is an opaque paper sheet, the sensor 33 outputs a specific signal. When the sheet material O is a transparent OHP sheet, the sensor does not output the specific signal, thereby reporting that a recording medium other than a paper sheet is passing. Either a reflection-type optical sensor or a transmission-type optical sensor capable of discriminating between a paper sheet and an OHP sheet may be used as the OHP identify sensor 33. In the embodiment, the reflection-type optical sensor is used for an adjusting function explained later.

The OHP identify sensor 33 identifies or senses the transport speed Va at which the sheet material O is transported toward the aligning rollers 20*a*, 20*b* of the aligning section 20. The above-described registration sensor 21 identifies or senses the transport speed Vb of the sheet material O at the transfer unit 2*a*.

Figure 6:
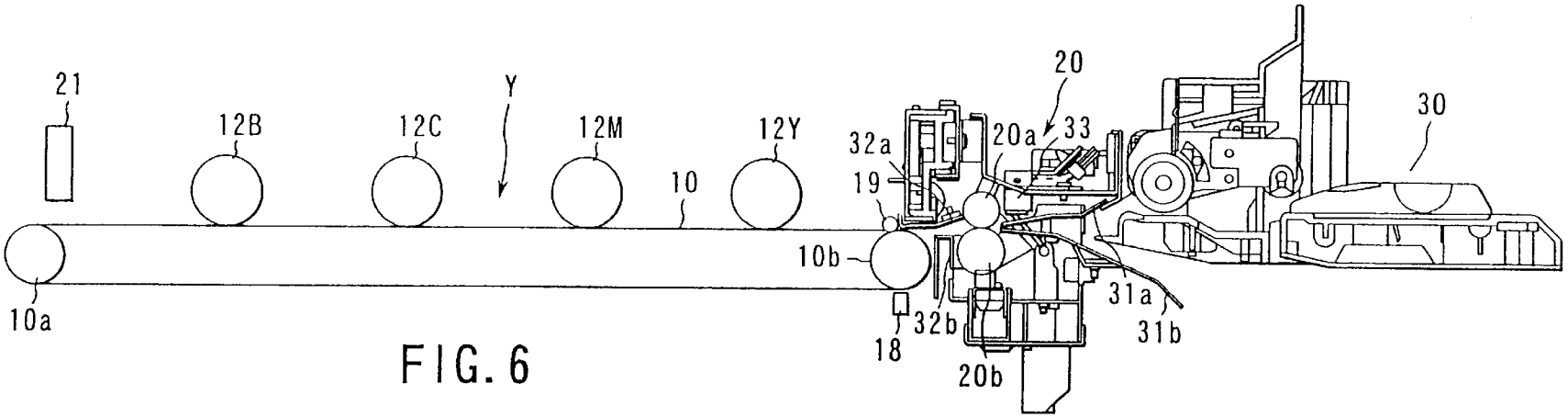
FIG. 6 is a schematic diagram to explain the operation of the image forming unit in the color image forming mode of the image forming apparatus of FIG. 1.
Figure 7:
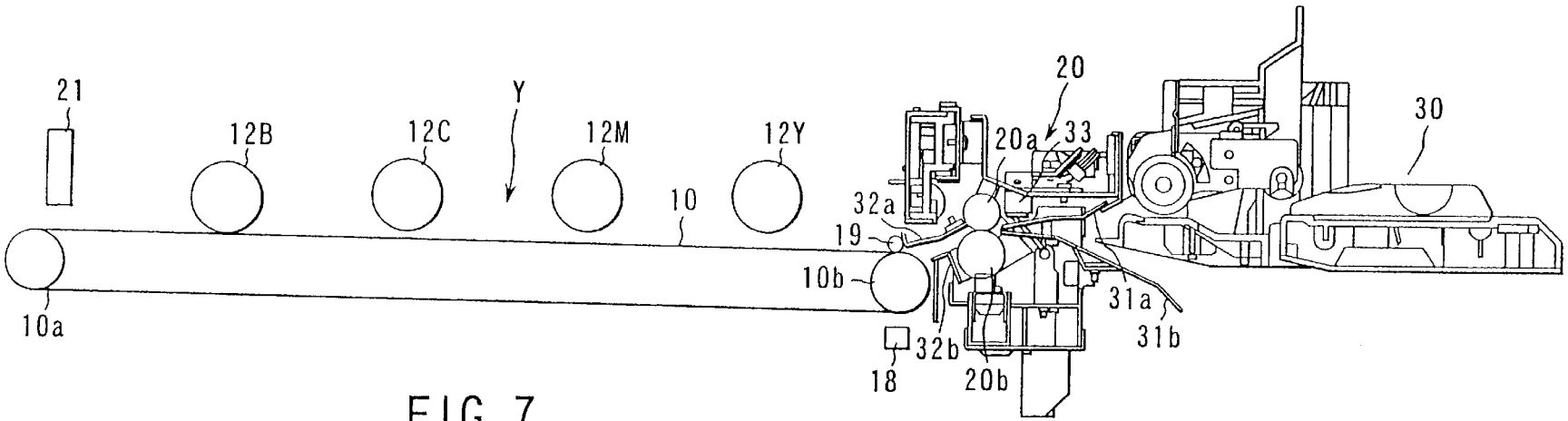
FIG. 7 is a schematic diagram to explain the operation of the image forming unit in the monochrome image forming mode of the image forming apparatus of FIG. 1.

As shown in FIG. 6, in the color mode, all the photosensitive drums 12 (Y, M, C and B) are brought into contact with the transfer belt 10. On the other hand, as shown in FIG. 7, in the monochrome mode, to prevent the image forming sections 11 (Y, M and C) for the color not used and the corresponding photosensitive drum 12 (Y, M and C) from wearing and deteriorating, the transfer unit 2*a* is tilted, centered on the pivotal contact part where the black photosensitive drum 12B of the fourth image forming section 11B comes into contact with the transfer belt 10, which frees the photosensitive drums 12 (Y, M and C) from the contact with the transfer belt 10 (or which separates the photosensitive drums 12Y, 12M, and 12C from the transfer belt 10).

As shown in FIG. 5, when the distance d between the contact point at which the aligning rollers 20*a*, 20*b* are in contact with each other on their outer surfaces and the electrification roller 19 is, for example, 46 mm, the total length d' of the sheet material when the sheet is bent most is 47.5 mm in the sheet material bending space defined by the second upper guide plate 32*a* and second lower guide plate 32*b* and the electrification roller 19. The maximum length Lp of the sheet material O usable in the color copying machine 101 of FIG. 1 is, for example, 11×17 (inches), or about 432 mm. Thus, the maximum bending allowed rate $\alpha$max of the sheet material that bends most in the bending space S in the longitudinal direction of the largest sheet of paper usable is defined as:

$$\alpha max=(d'-d)/Lp\approx 0.35\ (\%)$$

Therefore, to adjust the sheet material transport speed in the aligning section 20, it is necessary to make adjustments in such a manner that the bend in the sheet material O falls in the sheet material bending space S.

Figure 11:
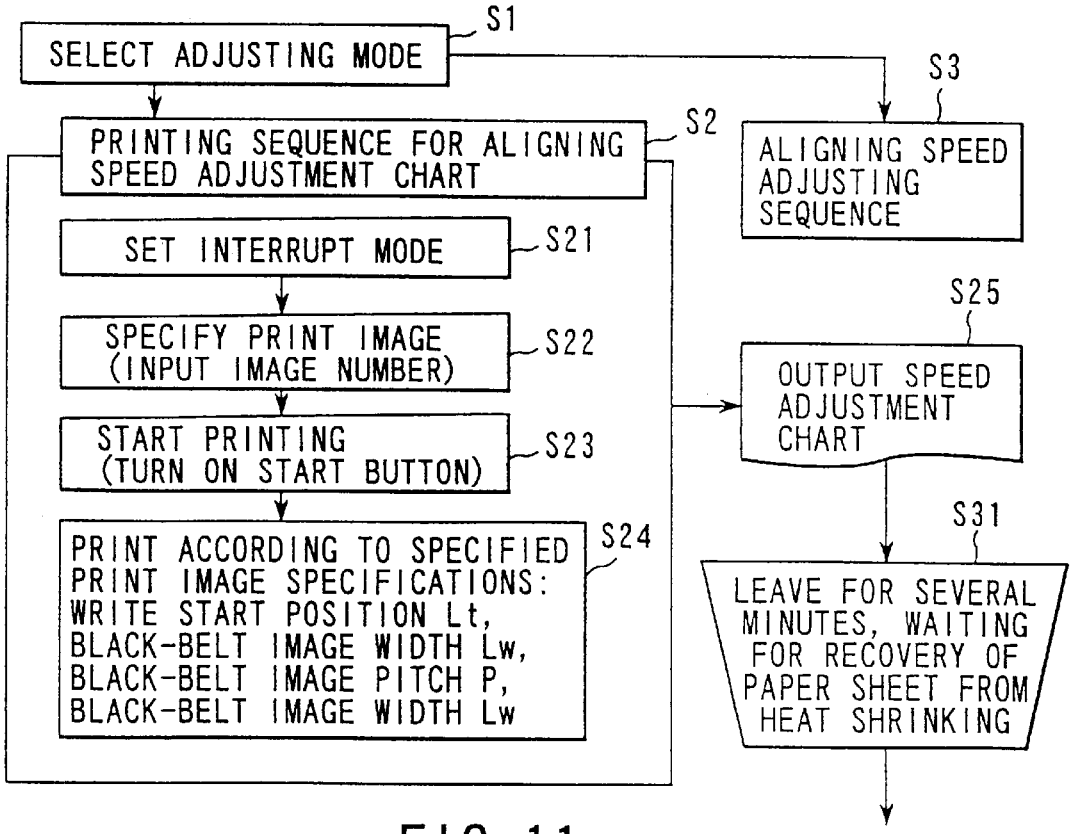
FIG. 11 is a flowchart to explain an example of adjusting the aligning speed of the image forming apparatus of FIG. 1.

Hereinafter, a method of controlling the number of revolutions of the aligning motor that rotates the aligning rollers 20*a*, 20*b* will be explained according to the actual adjusting operation. As shown in FIG. 11, the adjusting mode is first selected (S1).

Next, the print mode for the aligning section speed adjustment chart is selected from the adjusting mode (S2).

Figure 8:
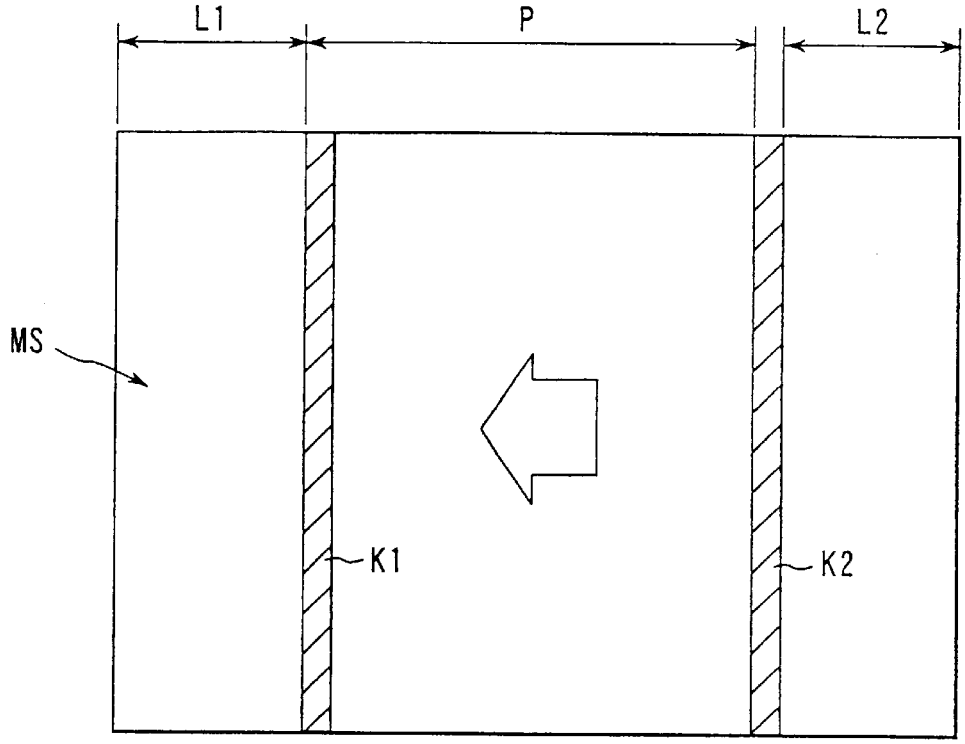
FIG. 8 is a schematic diagram to explain a speed adjustment chart used to adjust the transport speed in the image forming apparatus of FIG. 1.

Then, the interrupt mode is selected from the speed adjustment chart print mode (S21). After that, the image forming mode in which a measurement speed chart MS where two black-belt like images K1 and K2, images for measurement speed, (assuming the left side is the leading edge in transportation, the left black belt is called a first black-belt like image K1 and the right black belt at the trailing edge is called a second black-belt like image K2) have been drawn as shown in FIG. 8 is outputted is set. Because the image data corresponding to the chart MS has been sorted out by image number and stored in a ROM 123, the image number has only to be inputted from an input key 172 on an operator panel 171 (S22).

When the start button (copy key) 173 on the operator panel 171 is turned on, the formation of an image of the chart MS is started (S23). This forms the chart MS on which the first black-belt like image K1 whose write start position is Lt and whose width is Lw and the second black-belt like image K2 whose pitch to the first black-belt like image K1 is P and whose width is Lw have been formed (S24). The fixing unit 6 fixes the toner image on the sheet material O and outputs the resulting sheet material (S25). To make it easy for the OHP identify sensor 33 to sense the images, the thickness Lw of each of the first and second black-belt like images K1 and K2 is set to a thickness (a width) of about 10 mm.

The measurement speed chart MS on which the two black-belt like images K1, K2 have been formed as described above is left for several minutes to eliminate the effect of heat shrinking (S31).

Figure 12:
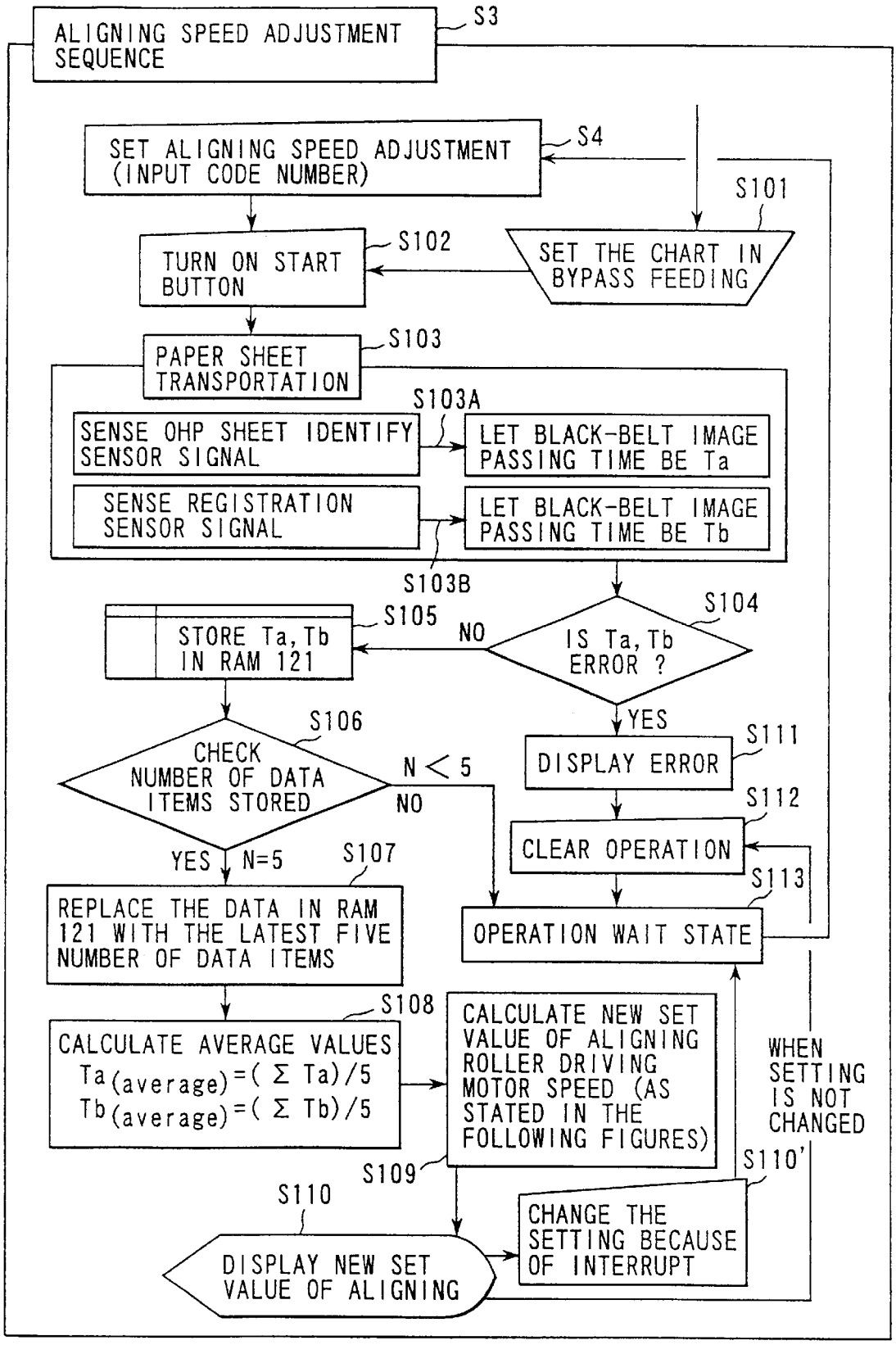
FIG. 12 is a flowchart to explain the sequence that follows the flowchart of FIG. 11.

Next, using the measurement speed chart MS formed in steps S21 to S25 explained above, the transport speed adjustment sequence for adjusting the speed at which the sheet material O is transported will be explained (S3). As shown in FIG. 12, the aligning speed adjusting mode is set. Since various controls in the speed adjusting mode have been sorted out by code number and stored in the ROM 123 beforehand, all the operator has to do is to enter the image number from the input key 172 on the operator panel 171 (S4).

In this case, a sheet material shorter than the distance between the position that contact part of the aligning rollers 20*a*, 20*b* and the transfer belt 10 and between the position that transfer belt 10 and the photosensitive drum 12B must be used, lest in the transport speed adjusting sequence, the sheet material O should be pulled by the black photosensitive drum 12B (the peripheral speed of the photosensitive drum 12B is faster than the peripheral speed of the aligning rollers 20*a*, 20*b*) or pushed out (the peripheral speed of the aligning rollers 20*a*, 20*b* is faster than the peripheral speed of the photosensitive drum 12B).

The distance L1 from the leading edge of the measurement speed chart MS of FIG. 8 to the leading edge of the first black-belt like image K1 and the distance L2 from the trailing edge of the second black-belt like image K2 to the trailing edge of the chart MS might vary, because the distance between the chart and the OHP sheet identify sensor 33 might vary as a result of the measurement speed chart MS adhering to the transfer belt 10 or lifting.

To prevent the OHP identify sensor 33 from outputting an erroneous result of measurement due to the fluctuations in the distance, the peripheral speed of the outer surface of the transport roller 34 has to be defined in such a manner that the measurement speed chart MS is stretched by the aligning rollers 20*a*, 20*b* and the transport roller 34 of the bypass feeding section 30. For this reason, the distance L1 and distance L2 are set longer than the distance (Lb-a shown in FIG. 5) between the contact part of the aligning rollers 20*a*, 20*b* and the paper transport roller 34.

It is assumed that the time difference between the timing of forming the black-belt like image K1 and that of forming the black-belt like image K2 corresponding to the pitch P between the black-belt like image K1 and second black-belt like image K2 is Tp.

Next, the measurement speed chart MS formed in steps S21 to S25 in FIG. 11 and left for several minutes is set in the bypass feeding section 30 (S101) and a start button 173 on the operator panel 171 is turned on (S102). Instead of forming the measurement speed chart MS, or the black-belts like K1, K1 in steps S21 to S25, a special chart (not shown) on which two black-belt like images have been formed may be used. However, the fact that the color copying machine 101 can form the measurement speed chart MS by itself has the advantages that it is not necessary to take into account the effect of, for example, moisture absorption on the accuracy of the measurement speed chart MS, that the operator need not carry the measurement speed chart MS with him or her for maintenance or inspection (may forget to carry it with him or her), and that the chart MS can be created and prepared whenever necessary, even if the chart MS is torn by mistake.

After the start button 173 has been turned on in step S102, the measurement speed chart MS set in the bypass feeding section 30 is conveyed toward the transport path of the color copying machine 101, or the aligning section 20, starting from one edge of the black-belt like image K1 (S103).

Hereinafter, it is sensed that the measurement speed chart MS being conveyed in step S103 has passed the OHP identify sensor 33 and registration sensor 21 during the time from when the black-belt like image K1 enters until the black-belt like image K2 enters (or during the time from when the trailing edge of the black-belt like image K1 has passed until the trailing edge of the black-belt like image K2 has passed) (S103A, S103B).

On the basis of the outputs of the sensors 33 and 21, the black-belt like image passing times Ta and Tb are obtained. Let the value measured by the OHP identify sensor 33 be Ta and the value measured by the registration sensor 21 be Tb.

Then, it is judged whether the measured values Ta and Tb thus obtained are abnormal times (measurement errors) (S104). When it has been judged that they are normal (NO in S104), they are recorded in the RAM 121 as similar values to the sheet material transport speed Va at the aligning section 20 and the transport speed Vb at the transfer belt 10 (S105).

Steps S101 to S105 are repeated more than once, for example, five times, taking into account measurement errors and the deviation of speed (or variations in the speed) at which the sheet material O passing through the aligning section 20 is transported (S106). Ta and Tb obtained by repetitive actions are sorted out and stored in the RAM 121. At this time, the number of measurement data items held in the RAM 121 is equal to the value obtained by a maximum of five repeats.

In step S106, after five Ta and Tb have been obtained, an averaging sequence is started and the five data items are replaced with the latest five data items stored in the RAM 121 (S107). The average values of Ta and Tb are calculated using the following equations (S108):

Ta (average)=(ΣTa)/5, and

Tb (average)=(ΣTb)/5

Next, using the number of revolutions of the aligning motor rotating the aligning rollers obtained in step S108 as a desired aligning paper transport speed, the number of revolutions of the aligning motor 20*m* calculated using equation (1) below is newly set as the set value expressed by the moving speed of the outer surface of the aligning rollers 20*a*, 20*b*, or the number of revolutions N(new) of the aligning motor 20*m* (S109, the present number of revolutions is represented as Ncurrent):

$$N(new) = \text{the present number of revolutions of aligning motor } N(current) \times \frac{\text{the desired aligning paper transport speed}}{\text{the present aligning paper transport speed}} \quad (1)$$

$$= N(current) \times \frac{P/Tb \times (1+\alpha)}{P/Ta}$$

$$= N(current) \times \frac{Ta \times (1+\alpha)}{Tb}$$

where α is the midpoint value between the aforementioned αmax and 0% and, in this case, 0.18%.

The new number of revolutions N(new) of the aligning motor 20*m* obtained in step S109 is inputted to an aligning motor driver 301 (S110) for driving the aligning motor 20*m*. Specifically, as shown in FIG. 13A, the aligning motor 20*m* that rotates the aligning rollers 20*a*, 20*b* is rotated at the new number of revolutions N(new) calculated using equation (1) during time Ta to Te from when the leading edge of the sheet material O has passed the contact part of the aligning rollers 20*a*, 20*b* until the trailing edge of the sheet material has been discharged.

Using equation (1), the relative difference between the sheet material transport speed Va at the aligning section 20 and the sheet material transport speed Vb on the transport belt 10 can be caused to fall in the proper relative speed range where the sheet material O can be conveyed in the range where the sheet material O can be bent in the bending space. Particularly in the color mode, color shift is prevented from occurring.

In step S104, when the OHP identify sensor 33 and/or the registration sensor 21 does not output the passing time of the black-belt like images K1, K2, because of the jamming of the sheet material O in the middle of transportation, or when the output from each sensor has been obtained but is surely erroneous (YES in S104), the error is reported to the main control unit 111 (S111) and control goes into an input wait state where a clear input is to be accepted (S112). The input wait state for accepting a clear input also serves as an input wait state when the new number of revolutions N(new) obtained in each step of changing the number of revolutions of the aligning motor 20*m* explained above is not used.

In the input wait state (S112), when the count cannot reach N=5 because the speed setting mode is interrupted or the sheet material O gets jammed in the middle of transportation (NO in S106), or when the new number of revolutions N(new) obtained in each step of changing the number of revolutions of the aligning motor 20*m* explained above is changed once more (S110'), control goes into an operation wait state where the input of the speed setting mode is to be accepted.

In the process of adjusting the transport speed of the sheet material O, each step up to step S107 may be executed as they are and step S108 and later may be controlled as described below.

For example, as shown in FIG. 13B, two types of the moving speed of the outer surfaces of the aligning rollers 20*a*, 20*b*, or the set value expressed by the number of revolutions N(new) of the aligning motor 20*m*, are calculated using equation (2) and equation (3) as follows (the present number of revolutions is represented by Ncurrent):

$$N(new1) = N(current) \times \frac{P/Tb}{P/Ta} = N(current) \times \frac{Ta}{Tb} \quad (2)$$

The desired value α % faster than that of the belt $$N(new2) = N(current) \times \frac{P/Tb \times (1+\alpha)}{P/Ta} = N(current) \times \frac{Ta \times (1+\alpha)}{Tb} \quad (3)$$

Specifically, the aligning motor 20*m* that rotates the aligning rollers 20*a*, 20*b* is rotated at the new number of revolutions N(new 1) obtained using equation (2) during time Ta to Ty from when the leading edge of the sheet material O has passed the contact part of the aligning rollers 20*a*, 20*b* until the leading edge of the sheet material O has reached the transfer position of the first image forming section 11Y. Thereafter, the aligning motor 20*m* is rotated at the new number of revolutions N(new 2) obtained using equation (3) during time Ty to Te from when the leading edge of the sheet material O has reached the transfer position of the first image forming section 11Y until the trailing edge of the sheet material O has been discharged.

Next, during the time from when the leading edge of the sheet material O has passed the aligning section 20 until the leading edge has reached the part (the first drum transfer section) where it comes into contact with the rotating photosensitive drum 12Y of the first image forming section 11Y, control is performed, using N(new1) as the set number of revolutions of the aligning motor 20*m*, in such a manner that the transport speed Va of the aligning section 20 becomes equal to the transport speed Vb at the transfer belt 10.

Then, after the leading edge of the sheet material O has passed the first drum transfer section, control is performed, using N(new2) as the set number of revolutions of the aligning motor 20*m*, in such a manner that the transport speed Va at the aligning section 20 is brought into the state where the transport speed Va is changed to Va' (Va'=Vb×(1+α)) faster than the transport speed Vb of the sheet material O on the transfer belt 10 by a specific ratio of α %.

In the process of adjusting the transport speed of the sheet material O, each step up to step S107 may be executed as they are and step S108 and later may be controlled as described below.

For example, as shown in FIG. 13C, three types of the moving speed, serving a desired aligning paper transport speed, of the outer surfaces of the aligning rollers 20*a*, 20*b*, or the set value expressed by the number of revolutions N(new 1, 2, 3) of the aligning motor 20*m*, are calculated using equation (4) to equation (6) as follows (the present number of revolutions is represented by Ncurrent):

$$N(new1) = N(current) \times \frac{P/Tb}{P/Ta} = N(current) \times \frac{Ta}{Tb} \quad (4)$$

The desired value α/2% faster than that of the belt $$N(new2) = N(current) \times \frac{P/Tb \times (1+\alpha/2)}{P/Ta} = N(current) \times \frac{Ta \times (1+\alpha/2)}{Tb} \quad (5)$$

The desired value α % faster than that of the belt $$N(new3) = N(current) \times \frac{P/Tb \times (1+\alpha)}{P/Ta} = N(current) \times \frac{Ta \times (1+\alpha)}{Tb} \quad (6)$$

Specifically, the aligning motor 20*m* that rotates the aligning rollers 20*a*, 20*b* is rotated at the new number of revolutions N(new 1) obtained using equation (4) during time Ta to Ty from when the leading edge of the sheet material O has passed the contact part of the aligning rollers 20*a*, 20*b* until the leading edge of the sheet material O has reached the transfer position of the first image forming section 11Y. Thereafter, the aligning motor 20*m* is rotated at the new number of revolutions N(new 2) obtained using equation (5) during time Ty to Tm from when the leading edge of the sheet material O has reached the transfer position of the first image forming section 11Y until the leading edge of the sheet material O has reached the transfer position of the second image forming section 11M. In addition, the aligning motor 20*m* is rotated at the new number of revolutions N(new 3) obtained using equation (6) during time Tm to Te from when the leading edge of the sheet material O has reached the transfer position of the second image forming section 11M until the trailing edge of the sheet material O has been discharged.

Next, during the time from when the leading edge of the sheet material O has passed the aligning section 20 until the leading edge has reached the first drum transfer section that is in rotatable contact with the photosensitive drum 12Y of the first image forming section 11, control is performed, using N(new 1) as the set number of revolutions of the aligning motor 20*m*, in such a manner that the sheet material transport speed Va at the aligning section 20 becomes equal to the transport speed Vb at the transfer belt 10.

Thereafter, from the first drum transfer section to the second drum transfer section where the rotating photosensitive drum 12M and the sheet material are in rotatable contact with each other, control is performed, using N(new 2) as the set number of revolutions of the aligning motor 20*m*, in such a manner that the sheet material transport speed Va at the aligning section 20 is brought into the state where the transport speed Va is changed to Va' ($Va'=Vb\times(1+\alpha/2)$) faster than the transport speed Vb at the transfer belt 10 by a specific ratio of $\alpha/2\%$.

Furthermore, after the leading edge of the sheet material O has passed the second drum transfer section, control is performed, using N(new3) as the set number of revolutions of the aligning motor 20*m*, in such a manner that the sheet material transport speed Va" at the aligning section 20 is changed so that it may be faster than the sheet material transport speed Va by a specific ratio of $\alpha$ %.

In addition to the effect explained in the setting of the number of revolutions of the aligning motor, the above example further suppresses the amount of the bend in the sheet of paper occurring at the aligning section 20, enabling a stable transport of the sheet material (or giving margins to the sheet material O).

A control method different from the methods of controlling the sheet material transport speed using equation (1), equations (2) and (3), and equations (4) to (6) will be explained.

(1) Start the speed adjusting mode at the aligning section.

(2) Select the interrupt mode. Then, from the menu of the interrupt mode, select the image forming mode in which a measurement speed chart MS on which black-belt like images K1 and K2 similar to those in FIG. 8 have been drawn is outputted.

(3) Start to form a test image, thereby forming the black-belt like images K1 and K2 on the measurement speed chart MS.

(4) set the created measurement speed chart MS on the bypass feeding section 30.

(5) Start the aligning speed adjusting sequence mode (FIG. 12).

(6) Cause the adjusting chart MS to pass through the bypass feeding section.

(7) Sense the passage of the black-belt like images K1 and K2 with the OHP sheet identify sensor 33. Prevent the registration sensor 21 from operating. Use the time difference Tp defining the pitch between the two back-belt like images K1 and K2 as Tb, the value measured by the sensor 21.

(8) As shown in FIG. 13A, the moving speed, serving as a goal, of the outer surfaces of the aligning rollers 20*a*, 20*b*, or the set value expressed by the number of revolutions N(new) of the aligning motor 20*m* is calculated using equation (7) and the calculated value is newly set as the number of revolutions of the aligning motor 20*m* (the present number of revolutions is represented by Ncurrent):

$$N(new) = N(current) \times \frac{Ta \times (1+\alpha)}{Tp} \tag{7}$$

Although the accuracy of this control method is lower than that of the above-described methods because of changes in the dimensions due to the heat shrinking of the sheet material, the error is negligibly small in terms of final speed accuracy. On the other hand, the method is very effective when the characteristic of the registration sensor 21 is unsuitable for sensing the black-belt like image, or for a monochrome copying machine with no registration sensor.

Furthermore, because in the control method, the difference in the timing of image formation is used as the sheet material transport speed of the transfer belt 10, the color copying machine 101 itself has to create a measurement speed chart MS to be passed through the aligning section 20.

Figure 9:
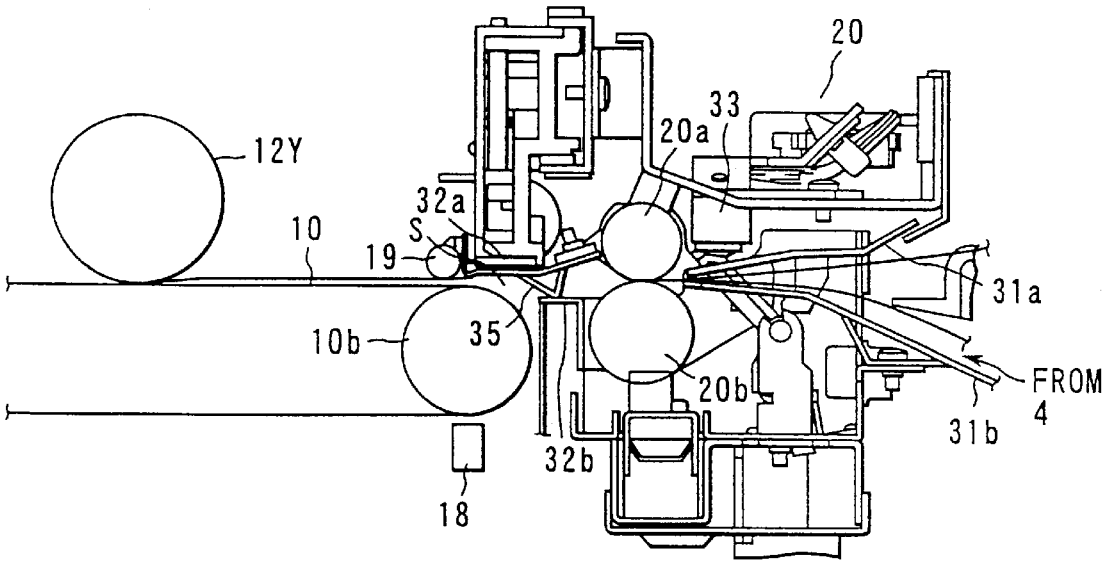
FIG. 9 is a schematic diagram to explain the operation of the image forming unit in the color image forming mode in the vicinity of the aligning section in the image forming apparatus of FIG. 1.
Figure 10:
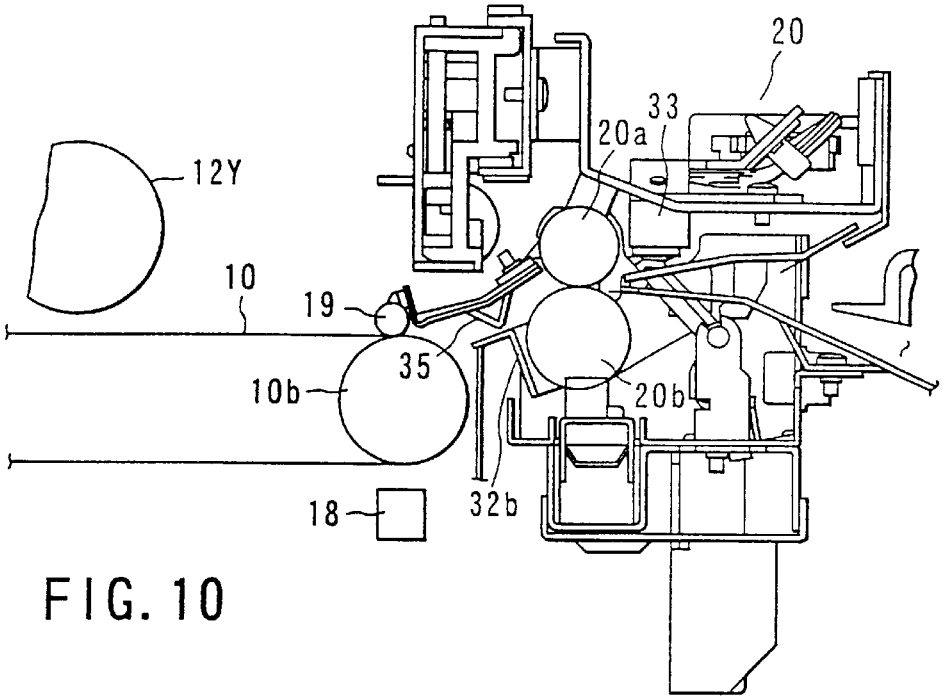
FIG. 10 is a schematic diagram to explain the operation of the image forming unit in the monochrome image forming mode in the vicinity of the aligning section in the image forming apparatus of FIG. 1.

Next, an example of changing the size of the bending space S will be explained by reference to FIGS. 9 and 10. FIGS. 9 and 10 are enlarged views of the transfer unit 2*a* and aligning section 20 explained in FIGS. 6 and 7. FIG. 9 shows the color mode state and FIG. 10 shows the monochrome mode state. The electrification roller 19 and second upper guide plate 32*a* are supported by the second lower guide plate 32*b* via a plate like spring 35. Thus, in the color mode shown in FIGS. 6 and 9, the electrification roller 19 has a specific clearance with the outer surface of the transfer belt 10. Because the electrification roller 19 is not enable, since an electrostatically absorption is occurred on the transfer belt 10 with transfer of the image formed by the first image forming section 11Y. Therefore, in the color mode shown in FIGS. 6 and 9, the electrification for the sheet material O is absented.

On the other hand, in the monochrome mode shown in FIGS. 7 and 10, the transfer unit 2*a* tilts and there is a clearance between the first to third photosensitive drums 12 (Y, M and C) and the transfer belt 10 as described above. As the transfer belt 10 tilts, the second lower guide plate 32*b* of the aligning section 20 tilts diagonally, causing a clearance with the plate like spring 35. This causes the electrification roller 19 to come into rotatable contact with the transfer belt 10. In the above path for the sheet material, the electrification unit 18 applies static electricity to the transfer belt 10, pressing the sheet material O pressed by the electrification roller 19 against the transfer belt 10, which causes the sheet material to make close contact with the transfer belt 10.

As described above, because in the color mode, the electrification roller 19 is not brought into contact with the transfer belt 10, the maximum paper sheet bending allowed rate $\alpha max$ in the sheet material bending space S increases:

$$\alpha max=(d'-d)/Lp$$

As a result, "d" explained in FIG. 5 increases to 110 mm and "d'" increases to 112 mm. Consequently, the maximum paper sheet bending allowed rate $\alpha max$ is increased from 0.35% to 0.48%. This enables the target value of the maximum paper sheet bending allowed rate $\alpha max$ to be set in a wider range than before.

In FIG. 14, the example of changing the size of the bending space S explained in FIGS. 9 and 10, when an electrification sheet material 219 made of, for example, elastic material is provided in place of the electrification roller 19, the size of the bending space S is expanded by about ¼ below the electrification sheet material 219 as compared with the electrification roller 19. Use of the elastic material alleviates the effect of jitters that might occur in the images, since the vibration at the moment that the sheet material O is separated from the suction sheet material when the sheet material is moved completely onto the transfer belt 10 is suppressed more than when the roller is used.

The elastic sheet material is liable to have an insufficient pressing function. In a curled sheet material O on whose one side an image has been formed, the entire area of the sheet material O does not adhere completely and might partly lift. Since in the monochrome mode, the clearance between the transfer belt 10 and the third photosensitive drum 12*c* is small, a curled sheet material O might get jammed.

Accordingly, it is desirable that two modes, separation and contact, of the transfer belt 10 with the photosensitive drum 12B should be prepared even in the monochrome mode and that a paper sheet should be transported and an image be formed in the state (contact) where all the photosensitive drums 12 are in contact with the transfer belt 10 in the manually selected state or in the double-sided image forming mode.

The example of providing not only the special OHP identify sensor 33 for identifying an OHP sheet in the aligning section 20 but also the registration sensor below the photosensitive drum (image forming section) located on the most downstream side in the method of rotating the outer surface of the transfer belt 10 to use equation (1) to equation (7) has been explained. Alternatively, equation (1) to equation (7) may be used by using a sensor for sensing the presence or absence of the sheet material O in the physical mechanism provided immediately in front of the aligning rollers 20*a*, 20*b* (on the transfer material feeding section 4 side) or the fixing unit 6 in the transport path of the sheet material O and by causing the sensor to recognize the leading edge and trailing edge of the sheet material O. In this case, the image forming sequence and the speed adjusting sequence can be executed simultaneously, making it possible to constantly monitor a temperature rise in the copying machine 101 and the transport speed of the sheet material O varying according to the surface change, such as wear of the aligning rollers 20*a*, 20*b*. In addition, averaging the obtained data several times enables the transport speed of the sheet material O to be constantly optimized.

As described above, with the present invention, the relative difference between the sheet material transport speed of the feeding unit and that of the image forming unit is caused to fall in the proper relative speed range agreeing with the amount by which the sheet material can be bent in the bendable space, which prevents a color shift from occurring particularly in the color mode.

Therefore, a color image forming apparatus capable of outputting color images free from a color shift or jitters is provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An imaging forming apparatus comprising:

an image forming section for forming images using developer;

a feeding mechanism for feeding an image forming medium to the image forming section, said feeding mechanism including an aligning roller rotated at the speeds defined by the following formulas:

$$N(new1)=N(current)\times(Ta/Tb),$$

$$N(new2)=N(current)\times(Ta\times(1+\alpha/2))/Tb, \text{ and}$$

$$N(new3)=N(current)\times(Ta\times(1+\alpha))/Tb,$$

where N is the number of revolutions, Ta is a first image passing time, Tb is a second image passing time, and $\alpha$ is the specific positive ratio at which an image forming medium is allowed to bend when it passes from the first sensing unit to the feeding mechanism;

a transport mechanism for transporting said image forming medium fed by the feeding mechanism;

a transfer unit for transferring the developer image by said image forming section onto said image forming medium;

a fixing unit for fixing the transferred developer image;

a first sensing unit for recognizing or sensing the transport speed Va of said image forming medium fed from said feeding mechanism to said image forming section;

a second sensing unit for recognizing or sensing the transport speed Vb of the image forming medium at said image forming section; and a control unit for comparing the transport speed Va of the image forming medium obtained from the first sensing unit and the transport speed Vb obtained from the second sensing unit and for controlling a proper relative speed with respect to the transport speed Va and the transport speed Vb, wherein the feeding speed of the image formed medium is controlled such that it satisfies the relationships (i) Va=Vb, (ii) $Va=Vb\times(1+\alpha/2)$, and (iii) $Va=Vb\times(1+\alpha)$ in that order.

2. The image forming apparatus according to claim 1, wherein said first and second sensing units use the leading edge and trailing edge of said medium on which the same image has been formed as objects to be sensed and execute an image forming operation sequence and a speed adjusting sequence.

3. An image forming apparatus comprising:

an image forming section for forming images using a developer, said imaging forming section being composed of a plurality of image forming units, each having an image retaining material, provided in series;

a feeding mechanism for feeding an image forming medium to the image forming section;

a transport mechanism for transporting said image forming medium fed by the feeding mechanism;

a transfer unit for transferring the developer image formed by said image forming section onto said image forming medium;

a fixing unit for fixing the transferred developer image;

a first sensing unit for recognizing or sensing the transport speed Va of said image forming medium fed from said feeding mechanism to said image forming section;

a second sensing unit for recognizing or sensing the transport speed Vb of the image forming medium at said image forming section;

a control unit for comparing the transport speed Va of the image forming medium obtained from the first sensing unit and the transport speed Vb obtained from the second sensing unit and for controlling a proper relative speed with respect to the transport speed Va and the transport speed Vb;

a first transport path which is formed while the clearance between the image retaining material of another image forming unit and the corresponding transfer unit increases as said image forming section rotates centering around the transfer position defined by the image retaining material in said image forming unit in the most downstream position and said transfer unit in said imaging forming section and which transports the medium directly to the transfer position on the transfer unit corresponding to the image retaining material in the image forming unit in the most downstream position, said first transport path including a charging unit for applying static electricity to said transport mechanism and a pressing mechanism for pressing said medium against said transport mechanism to cause the medium to make close contact with the mechanism; and a second transport path for transporting said medium from said feeding mechanism to the image forming unit in the most upstream position of the image forming section, said second transport path including a mechanism for expanding the medium bending space by retracting said pressing mechanism.

4. The image forming apparatus according to claim 3, wherein the transport speed Va of said medium at the feeding mechanism and the transport speed Vb of said medium at said image forming section are adjusted in such a manner that a state where the transport speed Va is faster than the transport speed Vb by a specific positive ratio of $\alpha$ %, $\alpha$ being the specific positive ratio at which an image forming medium is allowed to bend when it passes from the first sensing unit to the feeding mechanism, expressed by the following equation is satisfied:

$$Va=Vb\times(1+\alpha).$$

5. The image forming apparatus according to claim 4, wherein said control unit includes a storage unit for storing the results of measuring said transport speed Va and transport speed Va a plurality of times, and a computing unit for making calculations on the basis of the plurality of values stored in the storage unit, and uses the results of calculations done by the computing unit as speed comparison computed values.

6. The imaging forming apparatus according to claim 3, wherein said control unit adjusts the transport speed Va of said medium at the feeding mechanism and the transport speed Vb of said medium at said image forming section during the time from when the leading edge of said medium leaves said feeding mechanism until it reaches said image forming section in such a manner that a state where the transport speed Va is equal to the transport speed Vb expressed by the following equation is satisfied:

$$Va=Vb$$

and, after the leading edge of said medium has reached said image forming section, adjusts the transport speed Va of said medium at the feeding mechanism and the transport speed Vb of said medium at said image forming section in such a manner that a state where the transport speed Va is faster than the transport speed Vb by a specific positive ratio of $\alpha$ %, $\alpha$ being the specific positive ratio at which an image forming medium is allowed to bend when it passes from the first sensing unit to the feeding mechanism, expressed by the following equation is satisfied:

$$Va=Vb\times(1+\alpha).$$

7. The image forming apparatus according to claim 6, wherein said control unit includes a storage unit for storing the results of measuring said transport speed Va and transport speed Va a plurality of times, and a computing unit for making calculations on the basis of the plurality of values stored in the storage unit, and uses the results of calculations done by the computing unit as speed comparison computed values.

8. The imaging forming apparatus according to claim 3, wherein said control unit adjusts the transport speed Va of said medium at the feeding mechanism and the transport speed Vb of said medium at said image forming section during the time from when the leading edge of said medium leaves said feeding mechanism until it reaches said image forming section in such a manner that a state where the transport speed Va is equal to the transport speed Vb expressed by the following equation is satisfied:

$$Va=Vb$$

and, after the leading edge of said medium has reached said image forming section, increases the transport speed Va of said medium at the feeding mechanism and adjusts the transport speed Va and the transport speed Vb in such a manner that a state where the transport speed Va is faster than the transport speed Vb by a specific positive ratio of $\alpha$ %, $\alpha$ being the specific positive ratio at which an image forming medium is allowed to bend when it passes from the first sensing unit to the feeding mechanism, expressed by the following equation is satisfied:

$$Va=Vb\times(1+\alpha).$$

9. The image forming apparatus according to claim 8, wherein said control unit includes a storage unit for storing the results of measuring said transport speed Va and transport speed Va a plurality of times, and a computing unit for making calculations on the basis of the plurality of values stored in the storage unit, and uses the results of calculations done by the computing unit as speed comparison computed values.

10. The image forming apparatus according to claim 3, wherein said first sensing unit is a reflection-type or a transmission-type optical sensor for determining whether the medium is paper or OHP or verifying the passage of the medium and said second sensing unit is a registration sensor for sensing a shift in the position of an image which is an optical sensor for sensing and measuring various adjustment marks formed on said transport mechanism.

11. The image forming apparatus according to claim 3, wherein said first sensing unit is a reflection-type or a transmission-type optical sensor for determining whether the medium is paper or OHP or verifying the passage of the medium and said second sensing unit is a registration sensor for sensing a shift in the position of an image which is an optical sensor for sensing and measuring various adjustment marks formed on said transport mechanism.

12. The image forming apparatus according to claim 3, wherein the first transport path and second transport path can be selected automatically or manually according to the type of the medium transported in the sequence for allowing only said image forming unit in the most downstream position to transfer images.

13. An image forming apparatus comprising:

an image forming section for forming images using a developer;

a feeding mechanism for feeding an image forming medium to the image forming section;

a transport mechanism for transporting said image forming medium fed by the feeding mechanism;

a transfer unit for transferring the developer image formed by said image forming section onto said image forming medium;

a fixing unit for fixing the transferred developer image;

a first sensing unit for recognizing or sensing the transport speed Va of said image forming medium fed from said feeding mechanism to said image forming section;

a second sensing unit for recognizing or sensing the transport speed Vb of the image forming medium at said image forming section;

a control unit for comparing the transport speed Va of the image forming medium obtained from the first sensing unit and the transport speed Vb obtained from the second sensing unit and for controlling a proper relative speed with respect to the transport speed Va and the transport speed Vb wherein the objects to be sensed by said first sensing means and second sensing means are two adjustment images representing a distance of P formed on an adjustment chart and has a speed adjusting sequence mode in which the adjustment chart is transported, causing the first sensing means to sense the time Ta required for P to pass through and the second sending means to sense the time Tb required for P to pass through, which enables the transport speeds Va and Vb to be calculated from the required times Ta and Tb.

14. The image forming apparatus according to claim 13, wherein said adjustment chart is created by said image forming section itself before said speed adjusting sequence.

15. The image forming apparatus according to claim 14, wherein said adjustment chart is created by said image forming section itself in such a manner that the image forming time difference Tb' representing the preset distance P is extracted, the required time Tb is caused to be recognized as Tb', and the transport speed of the medium at the image forming means is recognized.

16. The image forming apparatus according to claim 10, wherein said adjustment chart is created by said image forming section itself in such a manner that the image forming time difference Tb' representing the preset distance P is extracted, the required time Tb is caused to be recognized as Tb', and the transport speed of the medium at the image forming means is recognized.

17. An image forming method in an image forming apparatus including an OHP sheet identify sensor for recognizing or sensing the transport speed Va of a medium fed from an aligning mechanism section to a transfer belt and a registration sensor for recognizing or sensing the transfer speed Vb of the medium on the transfer belt, said image forming method comprising the steps of:

comparing the transport speed Va of the medium obtained from said OHP sheet identify sensor with the transport speed Vb of the medium obtained from said registration sensor and adjusting the transport speed Va and the transport speed Vb in such a manner that a state where the transport speed Va is faster than the transport sped Vb by a specific positive ratio of $\alpha$ %, $\alpha$ being the specific positive ratio at which an image forming medium is allowed to bend when it passes from the first sensing unit to the feeding mechanism, expressed by the following equation is satisfied:

$$Va=Vb\times(1+\alpha).$$

18. An imaging forming apparatus comprising:

an image forming section for forming images using developer;

a feeding mechanism for feeding an image forming medium to the image forming section;

a transport mechanism for transporting said image forming medium fed by the feeding mechanism;

a transfer unit for transferring the developer image formed by said image forming apparatus onto said image forming medium;

a fixing unit for fixing the transferred developer image;

a first sensing unit which is a reflection-type or a transmission-type optical sensor for determining whether the medium is paper or OHP or verifying the passage of the medium and recognizes or senses the transport speed Va of said medium fed from said feeding mechanism to said image forming section;

a second sensing unit which is a registration sensor for sensing a shift in the position of a image that is an optical sensor for sensing and measuring various adjustment marks formed on said transfer means and recognizes or senses the transport speed Vb of the medium at said image forming section; and a control unit for comparing the transport speed Va of the medium obtained from the first sensing unit with the transport speed Vb of the medium obtained from the second sensing unit and controlling the transport speed Va of said medium at said feeding mechanism and the transport speed Vb of said medium at said image forming section to specific speeds in such a manner that the following equation is satisfied:

$$Va=Vb\times(1+\alpha),$$

$\alpha$ being the specific positive ratio at which an image forming medium is allowed to bend when it passes from the first sensing unit to the feeding mechanism.

* * * * *